US012270612B2

(12) United States Patent
Kawabata et al.

(10) Patent No.: US 12,270,612 B2
(45) Date of Patent: Apr. 8, 2025

(54) HEAT EXCHANGER AND METHOD OF MANUFACTURING HEAT EXCHANGER

(71) Applicant: Mitsubishi Electric Corporation, Tokyo (JP)

(72) Inventors: Ryohei Kawabata, Tokyo (JP); Masashi Nakamura, Tokyo (JP); Naoki Chiku, Tokyo (JP); Kota Inami, Tokyo (JP); Junki Oonishi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 330 days.

(21) Appl. No.: 17/912,339

(22) PCT Filed: Mar. 12, 2021

(86) PCT No.: PCT/JP2021/009971

§ 371 (c)(1),
(2) Date: Sep. 16, 2022

(87) PCT Pub. No.: WO2021/235055

PCT Pub. Date: Nov. 25, 2021

(65) Prior Publication Data

US 2023/0129209 A1 Apr. 27, 2023

(30) Foreign Application Priority Data

May 22, 2020 (WO) ..... PCT/JP2020/020355

(51) Int. Cl.
*F28F 9/02* (2006.01)
*B21D 53/02* (2006.01)
(Continued)

(52) U.S. Cl.
CPC . *F28D 7/16* (2013.01); *F28F 1/12* (2013.01)

(58) Field of Classification Search
CPC ..... F28F 9/0229; F28F 9/02; F28F 9/0202; F28F 9/0204; F28F 9/0207; F28F 9/0219;
(Continued)

(56) References Cited

U.S. PATENT DOCUMENTS 9,989,317 B2 6/2018 Katoh
2005/0217838 A1 10/2005 Katoh et al.
(Continued)

FOREIGN PATENT DOCUMENTS

JP 2011-214827 A 10/2011
JP 2013-029243 A 2/2013
(Continued)

OTHER PUBLICATIONS

Extended European Search Report dated Sep. 28, 2023 issued in corresponding EP Patent Application No. 21809841.6.
(Continued)

*Primary Examiner* — Steve S Tanenbaum
*Assistant Examiner* — Jason N Thompson
(74) *Attorney, Agent, or Firm* — Posz Law Group, PLC

(57) ABSTRACT

A heat exchanger has: a heat transfer tube group made up of plural heat transfer tubes each of which has, inside the heat transfer tube, a flow passage through which refrigerant flows; a fin provided on the heat transfer tubes; and a bridging header into which end portions of the heat transfer tubes are inserted and that causes refrigerant to flow between the heat transfer tubes. The bridging header has a base having a flat plate shape. The bridging header also has a corrugated sheet forming, between the corrugated sheet and the base, a header flow passage, through which refrigerant flows. The bridging header also has a covering plate covering the corrugated sheet and pressing the corrugated sheet toward the base.

16 Claims, 26 Drawing Sheets

(51) Int. Cl.
*F28D 7/16* (2006.01)
*F28F 1/12* (2006.01)

(58) Field of Classification Search
CPC ..... F28F 9/0221; F28F 9/026; F28F 9/0265; F28F 9/0268; F28F 9/0278; F28F 9/028; Y10T 29/49389; B23P 15/26; B21D 53/02; B21K 1/0012
See application file for complete search history.

(56) References Cited

U.S. PATENT DOCUMENTS

| | | | | |
|---|---|---|---|---|
| 2006/0162917 | A1 | 7/2006 | Park et al. | |
| 2008/0017364 | A1* | 1/2008 | Ichiyanagi | F28F 9/0209 165/173 |
| 2008/0023185 | A1* | 1/2008 | Beamer | F28F 9/0246 165/174 |
| 2008/0314076 | A1* | 12/2008 | Ichiyanagi | F25B 9/008 165/173 |
| 2009/0229805 | A1* | 9/2009 | Beamer | F28F 9/0243 29/890.052 |
| 2011/0024027 | A1 | 10/2011 | Mross et al. | |
| 2012/0204595 | A1* | 8/2012 | Tamaki | F28F 9/0278 165/151 |
| 2013/0020061 | A1* | 1/2013 | Bergh | F28D 1/0316 165/166 |
| 2015/0300758 | A1* | 10/2015 | Hofmann | F28F 9/0224 165/173 |
| 2017/0131043 | A1* | 5/2017 | Contet | F28F 9/0224 |
| 2017/0314792 | A1 | 11/2017 | Jindou et al. | |

FOREIGN PATENT DOCUMENTS

| | | | |
|---|---|---|---|
| JP | 2015-113983 | A | 6/2015 |
| JP | 5786877 | B2 | 9/2015 |
| JP | 2016-095086 | A | 5/2016 |
| JP | 2019-027614 | A | 2/2019 |
| WO | 2016/076260 | A1 | 5/2016 |

OTHER PUBLICATIONS

International Search Report of the International Searching Authority mailed Apr. 20, 2021 in corresponding International application No. PCT/JP2020/009971 (and English translation).
International Search Report of the International Searching Authority mailed Aug. 4, 2020 in corresponding International application No. PCT/JP2020/020355 (and English translation).
Office Action dated May 16, 2023 issued in corresponding JP Patent Application No. 2022-524897 (and English translation).

* cited by examiner

HEAT EXCHANGER AND METHOD OF MANUFACTURING HEAT EXCHANGER

CROSS REFERENCE TO RELATED APPLICATIONS

This application is a U.S. national stage application of PCT/JP2021/009971 filed on Mar. 12, 2021, which claims priority to International Patent Application No. PCT/JP2020/020355 filed on May 22, 2020, the contents of which are incorporated herein by reference.

TECHNICAL FIELD

The present disclosure relates a heat exchanger having a bridging header and a method of manufacturing a heat exchanger.

BACKGROUND ART

There has been known a heat exchanger having pairs of mutually facing heat transfer tubes. In the pairs, the heat transfer tubes in a first row and the heat transfer tubes in a second row extend parallel to one another. Regarding such a heat exchanger, a bridging header into which end portions of the heat transfer tubes are inserted has flow passages. In each of the flow passages, refrigerant flows only between a pair of the heat transfer tubes. That is, in the bridging header, the refrigerant that has flowed into the bridging header from a heat transfer tube arranged in the first row does not merge with the flow of the refrigerant that has flowed into the bridging header from another heat transfer tube arranged in the first row. Patent Literature 1 discloses a heat exchanger having a base into which heat transfer tubes are inserted and a bridging header constituted by a corrugated sheet that is provided on the base and that has a wavy shape in which semicircular column portions are continuously formed. Each of the semicircular column portions of the corrugated sheet covers points at which the paired heat transfer tubes are inserted and forms a flow passage between the semicircular column portion and the base.

CITATION LIST

Patent Literature

Patent Literature 1: Japanese Patent No. 5786877

SUMMARY OF INVENTION

Technical Problem

However, the corrugated sheet of the heat exchanger of Patent Literature 1 is required to be thickened so as not to be deformed by the pressure of the refrigerant flowing through the bridging header. In most cases, a thickened corrugated sheet is likely to interfere with the inserted heat transfer tube and is likely to cover, in a hindering way, a point at which the heat transfer tube is inserted. In the heat exchanger of the Patent Literature 1, because being thickened, the corrugated sheet reduces a region, in the base, into which the heat transfer tubes can be inserted. Thus, regarding the heat exchanger of Patent Literature 1, for example, the number of the heat transfer tubes that are inserted into the bridging header and a space between the heat transfer tubes are limited, and design flexibility is thus decreased.

The present disclosure has been made to solve such an above-described problem and provides: a heat exchanger enabling adjustment of, for example, the number of the heat transfer tubes that are inserted into a bridging header and a space between the heat transfer tubes and thus enabling increase in design flexibility; and a method of manufacturing the heat exchanger.

Solution to Problem

A heat exchanger of one embodiment of the present disclosure has: a heat transfer tube group made up of plural heat transfer tubes each of which has, inside the heat transfer tube, a flow passage through which refrigerant flows, the plural heat transfer tubes that are arranged in a lateral direction being arranged in a longitudinal direction so as to form plural rows; a fin provided on the heat transfer tubes and facilitating heat exchange between refrigerant flowing inside the heat transfer tubes and air; and a bridging header into which end portions of the heat transfer tubes are inserted and that causes refrigerant to flow between the heat transfer tubes arranged in a lateral direction of the heat transfer tube group. The bridging header has a base having a flat plate shape and having insertion holes into which respective ones of end portions of the plurality of heat transfer tubes are inserted. The bridging header also has a corrugated sheet being a plate having a shape of a wave in which crest portions and valley portions are continuously formed, each of the crest portions being provided so as to cover a pair of the insertion holes arranged in a lateral direction, the valley portions being in contact with the base on both sides of each of the insertion holes in a longitudinal direction of the base, the corrugated sheet forming, between the corrugated sheet and the base, a header flow passage, through which refrigerant flows, for every the heat transfer tubes arranged in a lateral direction of the heat transfer tube group. The bridging header also has a covering plate covering the corrugated sheet and pressing the corrugated sheet toward the base.

A method of manufacturing a heat exchanger of another embodiment of the present disclosure includes: assembling: a heat transfer tube group made up of plural heat transfer tubes each of which has, inside the heat transfer tube, a flow passage through which refrigerant flows, the plural heat transfer tubes that are arranged in a lateral direction being arranged in a longitudinal direction so as to form plural rows; a fin provided on the heat transfer tubes and facilitating heat exchange between refrigerant flowing inside the heat transfer tubes and air; and a bridging header into which end portions of the heat transfer tubes are inserted and that causes refrigerant to flow between the heat transfer tubes arranged in a lateral direction of the heat transfer tube group. The method also includes performing brazing of the heat transfer tube group, the fin, and the bridging header. The assembling includes: fitting the corrugated sheet of the bridging header into the base, of the bridging header, having insertion holes into which respective ones of end portions of the plurality of heat transfer tubes are inserted, the fitting being performed so that, in the corrugated sheet being a plate having a shape of a wave in which crest portions and valley portions are continuously formed, each of the crest portions covers a pair of the insertion holes arranged in a lateral direction, and the valley portions are in contact with the base on both sides of each of the insertion holes in a longitudinal direction of the base; and carrying out attachment of a covering plate so that the covering plate covers the corrugated sheet.

Advantageous Effects of Invention

According to an embodiment of the present disclosure, the bridging header has the covering plate that presses the corrugated sheet toward the base. Thus, the corrugated sheet is suppressed from being deformed by the pressure of the refrigerant flowing through the bridging header. That is, for suppressing the corrugated sheet from being deformed by the pressure of the refrigerant flowing through the bridging header, the corrugated sheet is not required to be thickened. Consequently, regarding the heat exchanger, for example, the number of the heat transfer tubes that are inserted into the bridging header and a space between the heat transfer tubes can be adjusted, and design flexibility can thus be increased.

DESCRIPTION OF EMBODIMENTS

Embodiment 1

Figure 1:
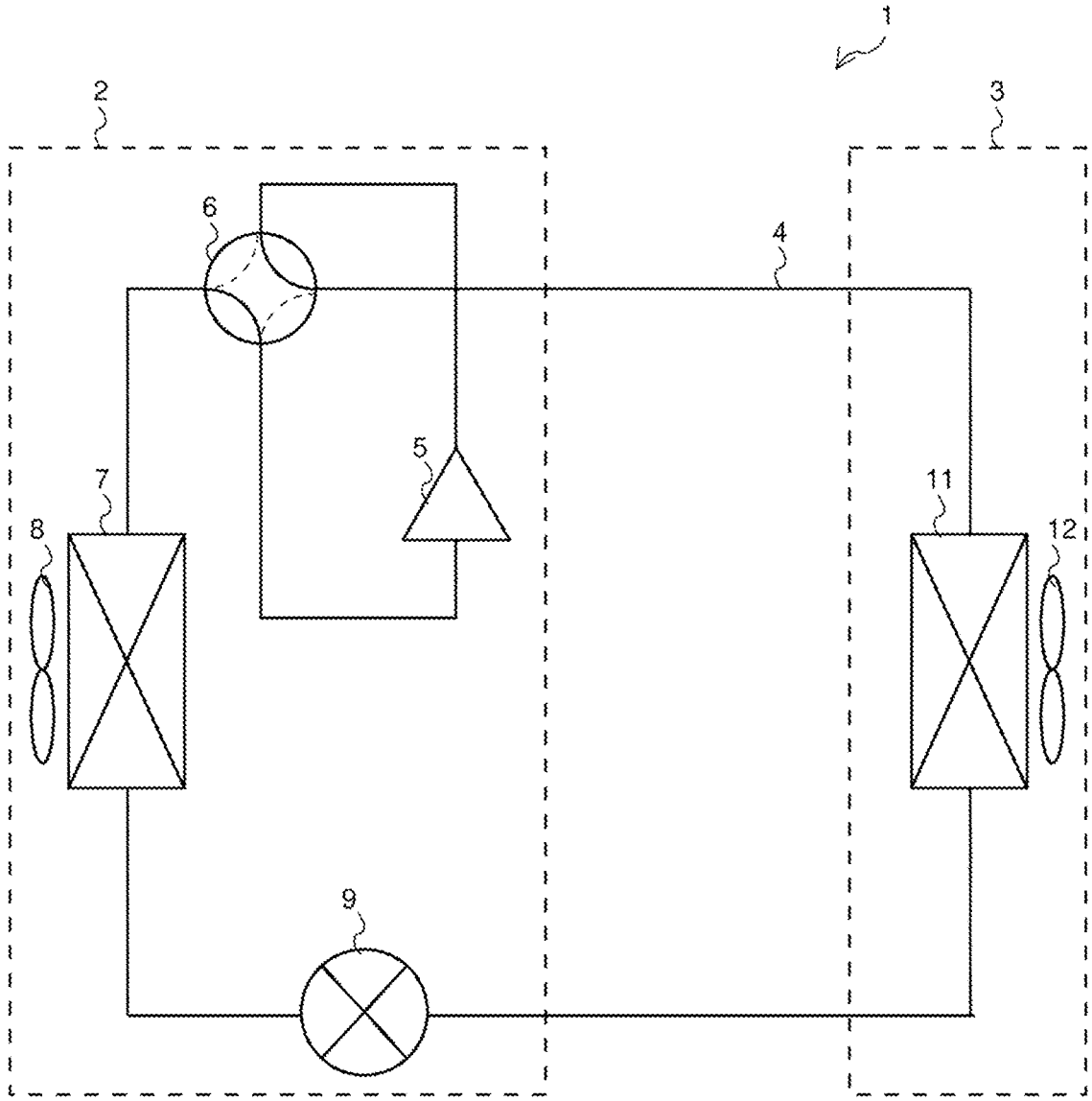
FIG. 1 is a circuit diagram of an air-conditioning apparatus 1 according to Embodiment 1.

Hereinafter, an air-conditioning apparatus 1 provided with a heat exchanger 7 according to Embodiment 1 will be described with reference to the drawings. In addition, the heat exchanger 7 may be provided for an apparatus other than the air-conditioning apparatus 1. FIG. 1 is a circuit diagram of the air-conditioning apparatus 1 according to Embodiment 1. As FIG. 1 illustrates, the air-conditioning apparatus 1 has an outdoor unit 2, an indoor unit 3, and a refrigerant pipe 4. Note that, although FIG. 1 illustrates the single indoor unit 3, the number of the indoor units 3 may be two or more.

(Outdoor Unit 2, Indoor Unit 3, and Refrigerant Pipe 4)

The outdoor unit 2 includes a compressor 5, a flow-switching device 6, the heat exchanger 7, an outdoor fan 8, and an expansion unit 9. The indoor unit 3 includes an indoor heat exchanger 11 and an indoor fan 12. The refrigerant pipe 4 constitutes a refrigerant circuit by connecting the compressor 5, the flow-switching device 6, the heat exchanger 7, the expansion unit 9, and the indoor heat exchanger 11 to one another and by allowing refrigerant to flow inside the refrigerant pipe 4.

(Compressor 5, Flow-Switching Device 6, Heat Exchanger 7, Outdoor Fan 8, and Expansion Unit 9)

The compressor 5 sucks low-temperature and low-pressure refrigerant, compresses the sucked refrigerant to bring the refrigerant into a high-temperature and high-pressure state, and discharges the refrigerant. The flow-switching device 6 switches flowing directions of refrigerant in the refrigerant circuit and is, for example, a four-way valve. The heat exchanger 7 exchanges heat between refrigerant and outdoor air. The heat exchanger 7 operates as a condenser during a cooling operation and operates as an evaporator during a heating operation. The outdoor fan 8 is a device for sending outdoor air to the heat exchanger 7. The expansion unit 9 is a pressure-reducing valve or an expansion valve for reducing the pressure of refrigerant to expand the refrigerant.

(Indoor Heat Exchanger 11 and Indoor Fan 12)

The indoor heat exchanger 11 exchanges heat between indoor air and refrigerant. The indoor heat exchanger 11 operates as an evaporator during the cooling operation and operates as a condenser during the heating operation. The indoor fan 12 is a device for sending indoor air to the indoor heat exchanger 11.

(Cooling Operation)

Here, an operation of the air-conditioning apparatus 1 will be described. First, the cooling operation will be described. In the cooling operation, the refrigerant sucked into the compressor 5 is compressed by the compressor 5, and the refrigerant that has turned into a high-temperature and high-pressure gas state is discharged from the compressor 5. The high-temperature and high-pressure gas state refrigerant that has been discharged from the compressor 5 passes through the flow-switching device 6 and flows into the heat exchanger 7 operating as a condenser. The refrigerant that has flowed into the heat exchanger 7 exchanges heat with the outdoor air sent by the outdoor fan 8 and is thus condensed to be liquefied. The refrigerant in a liquid state flows into the expansion unit 9 and is reduced in pressure and expanded to turn into a low-temperature and low-pressure two-phase gas-liquid state. The refrigerant in a gas-liquid two-phase state flows into the indoor heat exchanger 11 operating as an evaporator. The refrigerant that has flowed into the indoor heat exchanger 11 exchanges heat with the indoor air sent by the indoor fan 12 and is thus evaporated to be gasified. At this time, the indoor air is cooled and air cooling is performed in a room. Subsequently, the evaporated refrigerant in a low-temperature and low-pressure gas state passes through the flow-switching device 6 and is sucked into the compressor 5.

(Heating Operation)

Next, the heating operation will be described. In the heating operation, the refrigerant sucked into the compressor 5 is compressed by the compressor 5, and the refrigerant that has turned into a high-temperature and high-pressure gas state is discharged from the compressor 5. The high-temperature and high-pressure gas state refrigerant that has been discharged from the compressor 5 passes through the flow-switching device 6 and flows into the indoor heat exchanger 11 operating as a condenser. The refrigerant that has flowed into the indoor heat exchanger 11 exchanges heat with the indoor air sent by the indoor fan 12 and is thus condensed to be liquefied. At this time, the indoor air is heated and air heating is performed in the room. The refrigerant in a liquid state flows into the expansion unit 9 and is reduced in pressure and expanded to turn into a low-temperature and low-pressure two-phase gas-liquid state. The refrigerant in a gas-liquid two-phase state flows into the heat exchanger 7 operating as an evaporator. The refrigerant that has flowed into the heat exchanger 7 exchanges heat with the outdoor air sent by the outdoor fan 8 and is thus evaporated to be gasified. Subsequently, the evaporated refrigerant in a low-temperature and low-pressure gas state passes through the flow-switching device 6 and is sucked into the compressor 5.

(Heat Exchanger 7)

Figure 2:
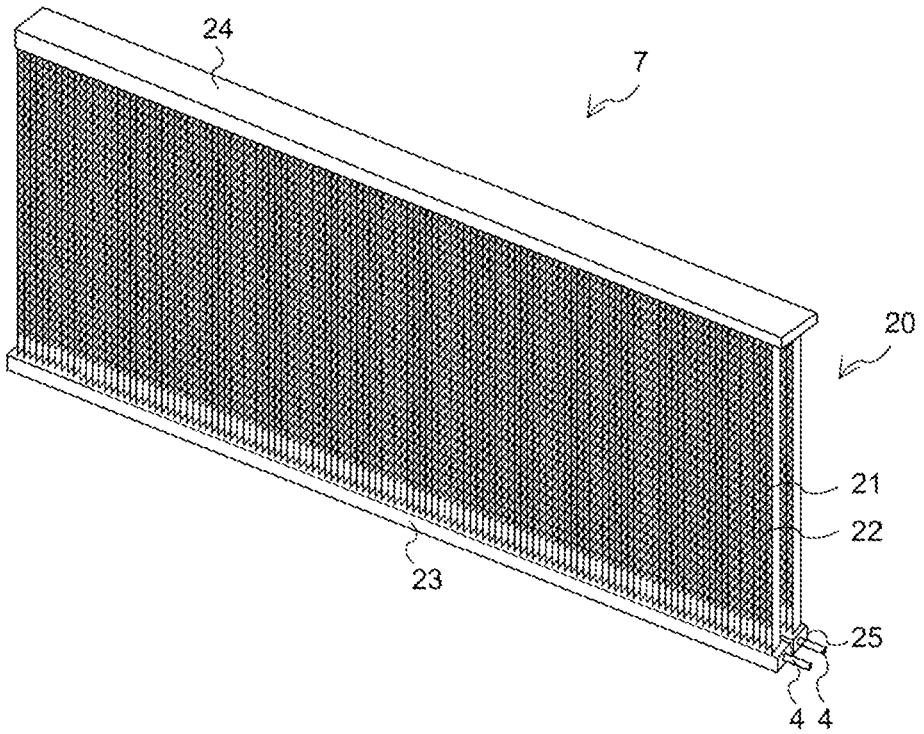
FIG. 2 is a perspective view of a heat exchanger 7 according to Embodiment 1.

FIG. 2 is a perspective view of the heat exchanger 7 according to Embodiment 1. Here, the configuration of the heat exchanger 7 will be described in detail. The heat exchanger 7 has a heat transfer tube group 20, a fin 22, a first lower header 23, a bridging header 24, and a second lower header 25. Note that a configuration similar to the configuration of the heat exchanger 7 may be applied to the indoor heat exchanger 11.

(Heat Transfer Tube Group 20 and Fin 22)

The heat transfer tube group 20 is constituted by plural heat transfer tubes 21. The heat transfer tubes 21 arranged in the lateral direction are arranged in the longitudinal direction so as to form plural rows. The heat transfer tubes 21 are, for example, flat tubes and have plural flow passages (not illustrated) inside which refrigerant flows. In Embodiment 1, each of the heat transfer tubes 21 extends in the vertical direction. Note that the heat transfer tube 21 may alternatively extend in a direction other than the vertical direction. In this case, other parts of the heat exchanger 7 are also assembled based on the direction where the heat transfer tube 21 extends. In addition, in Embodiment 1, the heat transfer tubes 21 form two rows that are a first row and a second row extending parallel to one another. Note that the heat transfer tubes 21 may extend in three or more rows. The fin 22, which is, for example, a corrugated fin, is provided on the heat transfer tubes 21 and facilitates heat exchange between the refrigerant flowing inside the heat transfer tubes 21 and air.

(First Lower Header 23)

The first lower header 23 is a header into which an end portion on one side of each of the heat transfer tubes 21 arranged in the first row is inserted. The refrigerant pipe 4 is connected to the first lower header 23. The first lower header 23 distributes the refrigerant that has flowed into the first lower header 23 from the refrigerant pipe 4 to the heat transfer tubes 21 arranged in the first row. The first lower header 23 also causes the refrigerant that has merged with the refrigerant flow in the first lower header 23 from the heat transfer tubes 21 arranged in the first row to flow out into the refrigerant pipe 4.

(Bridging Header 24)

The bridging header 24 is a header that faces the first lower header 23 and the second lower header 25 and into which an end portion on the other side of each of the heat transfer tubes 21 arranged in the first row and in the second row is inserted. The bridging header 24 distributes the refrigerant that has merged with the refrigerant flow in the bridging header 24 from a heat transfer tube 21 arranged in the first row to a heat transfer tube 21 arranged in the second row. The bridging header 24 also distributes the refrigerant that has merged with the refrigerant flow in the bridging header 24 from the heat transfer tube 21 arranged in the second row to the heat transfer tube 21 arranged in the first row and facing, in the lateral direction, the heat transfer tube 21 arranged in the second row.

Figure 3:
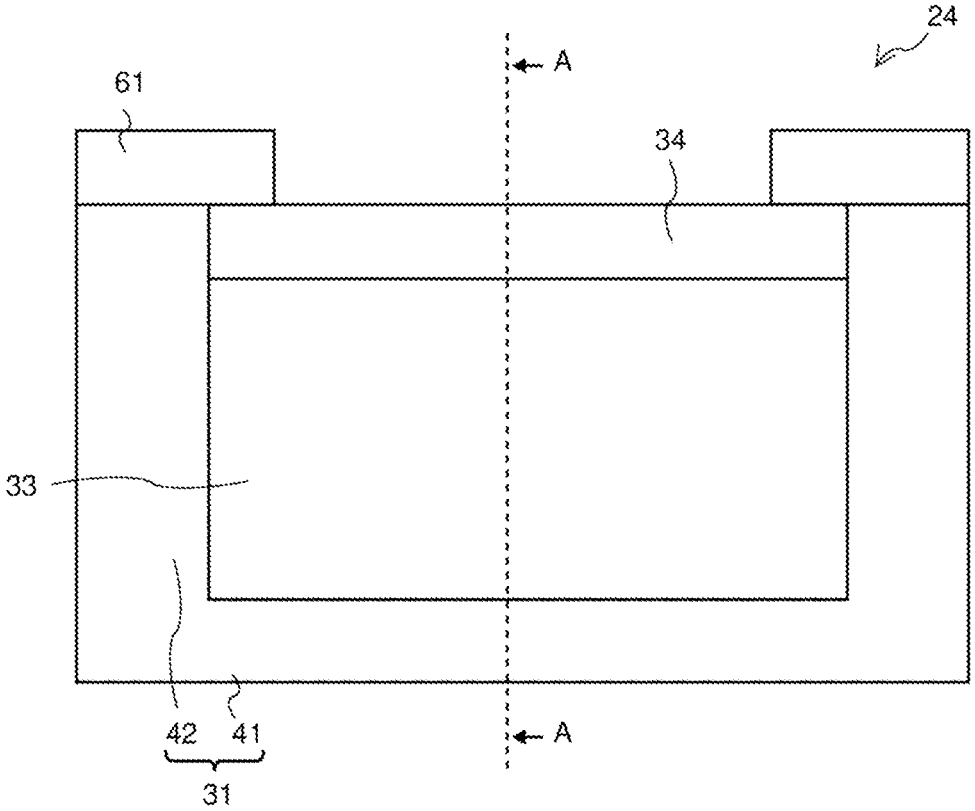
FIG. 3 is a side view of a bridging header 24 according to Embodiment 1.
Figure 4:
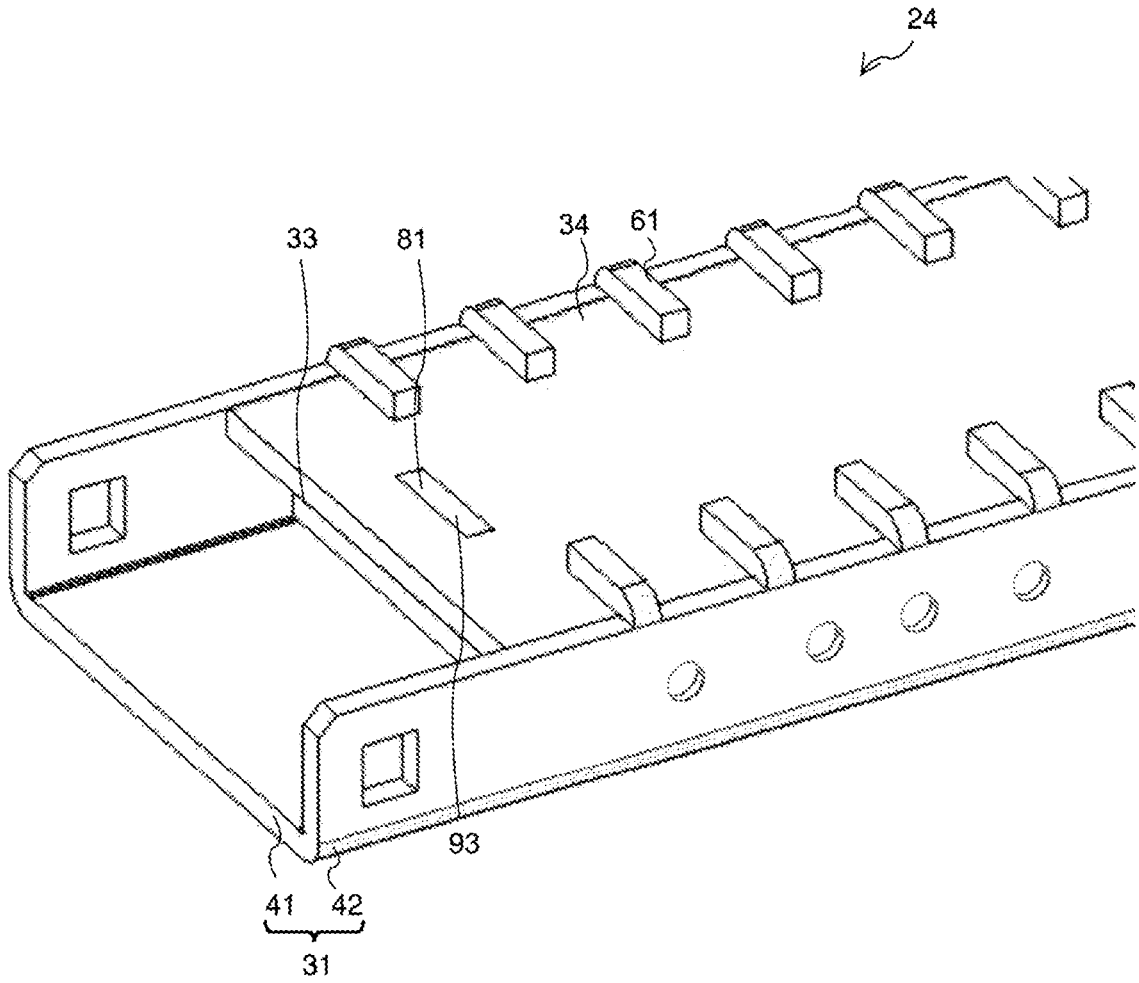
FIG. 4 is a perspective view of the bridging header 24 according to Embodiment 1.
Figure 5:
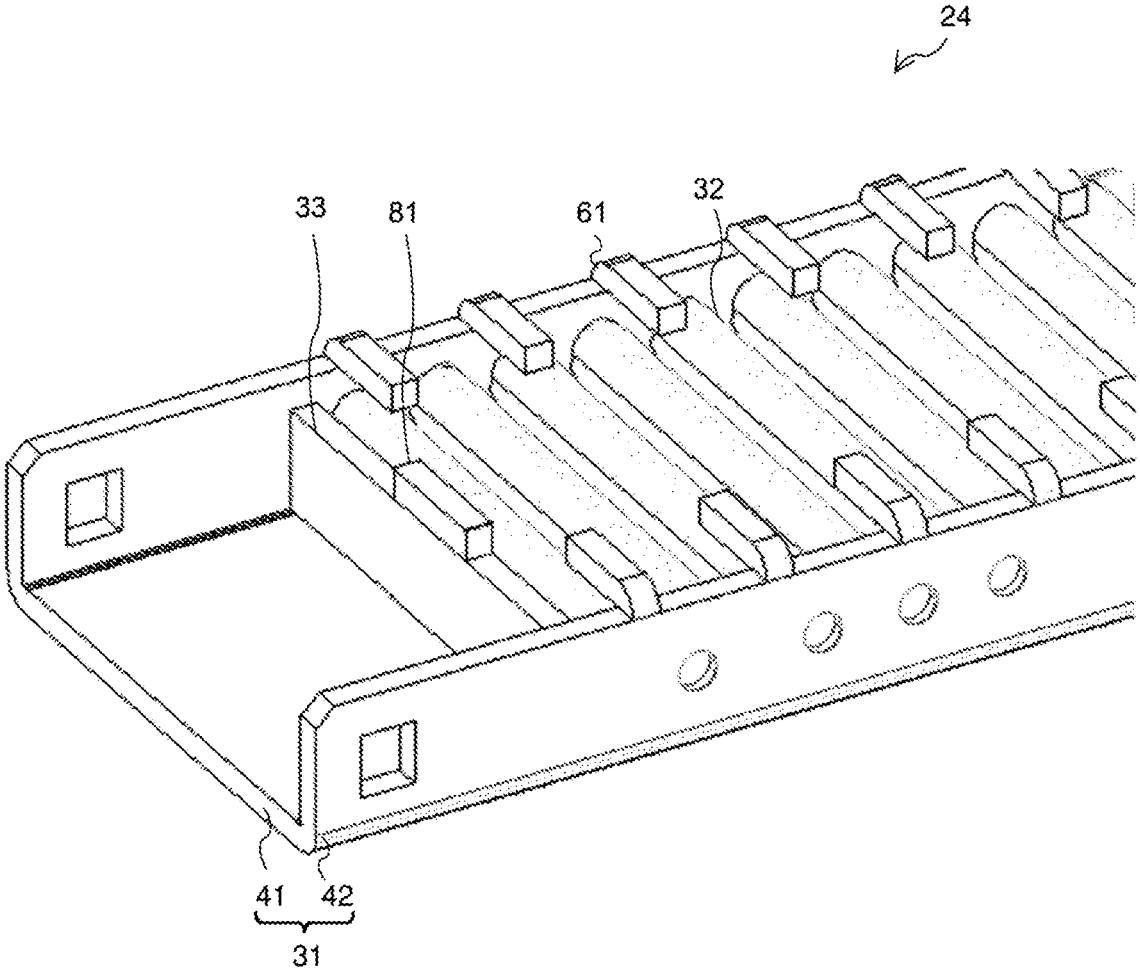
FIG. 5 is a perspective view of the bridging header 24 according to Embodiment 1.

FIG. 3 is a side view of the bridging header 24 according to Embodiment 1. FIG. 3 illustrates the bridging header 24, when the bridging header 24 is viewed in the longitudinal direction. FIG. 4 is a perspective view of the bridging header 24 according to Embodiment 1. FIG. 5 is a perspective view of the bridging header 24 according to Embodiment 1. Note that, in FIG. 5, a covering plate 34 is transparent for an illustration purpose. As FIGS. 3 to 5 illustrate, the bridging header 24 has a base 31, a corrugated sheet 32, the covering plate 34, and an end plate 33.

(Base 31)

Figure 6:
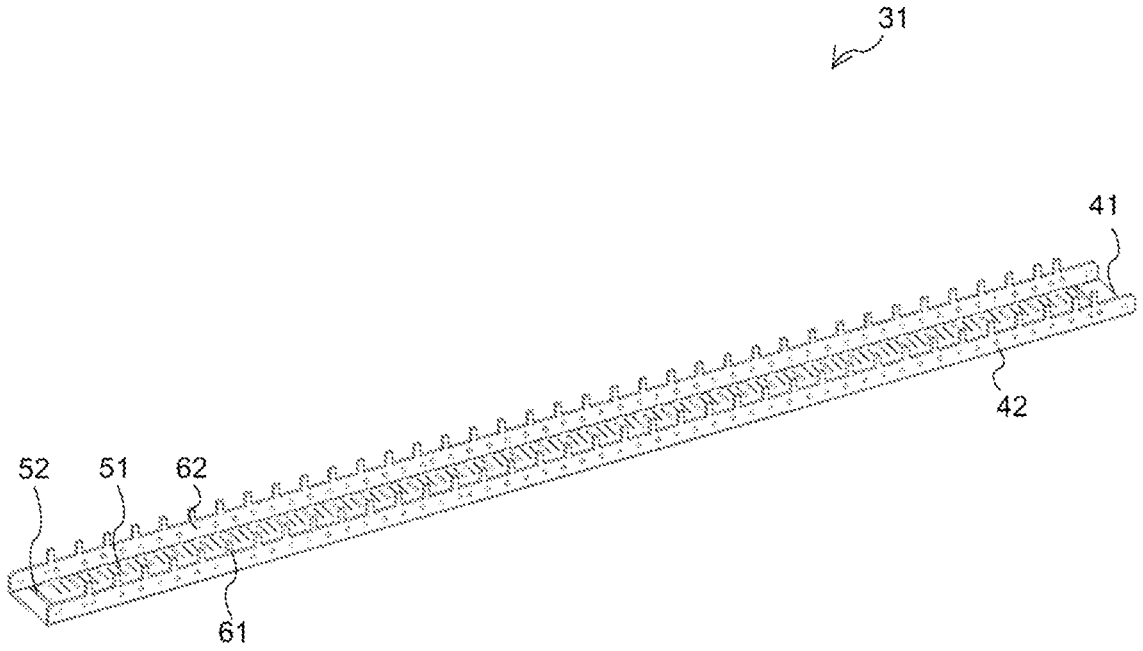
FIG. 6 is a perspective view of a base 31 according to Embodiment 1.
Figure 7:
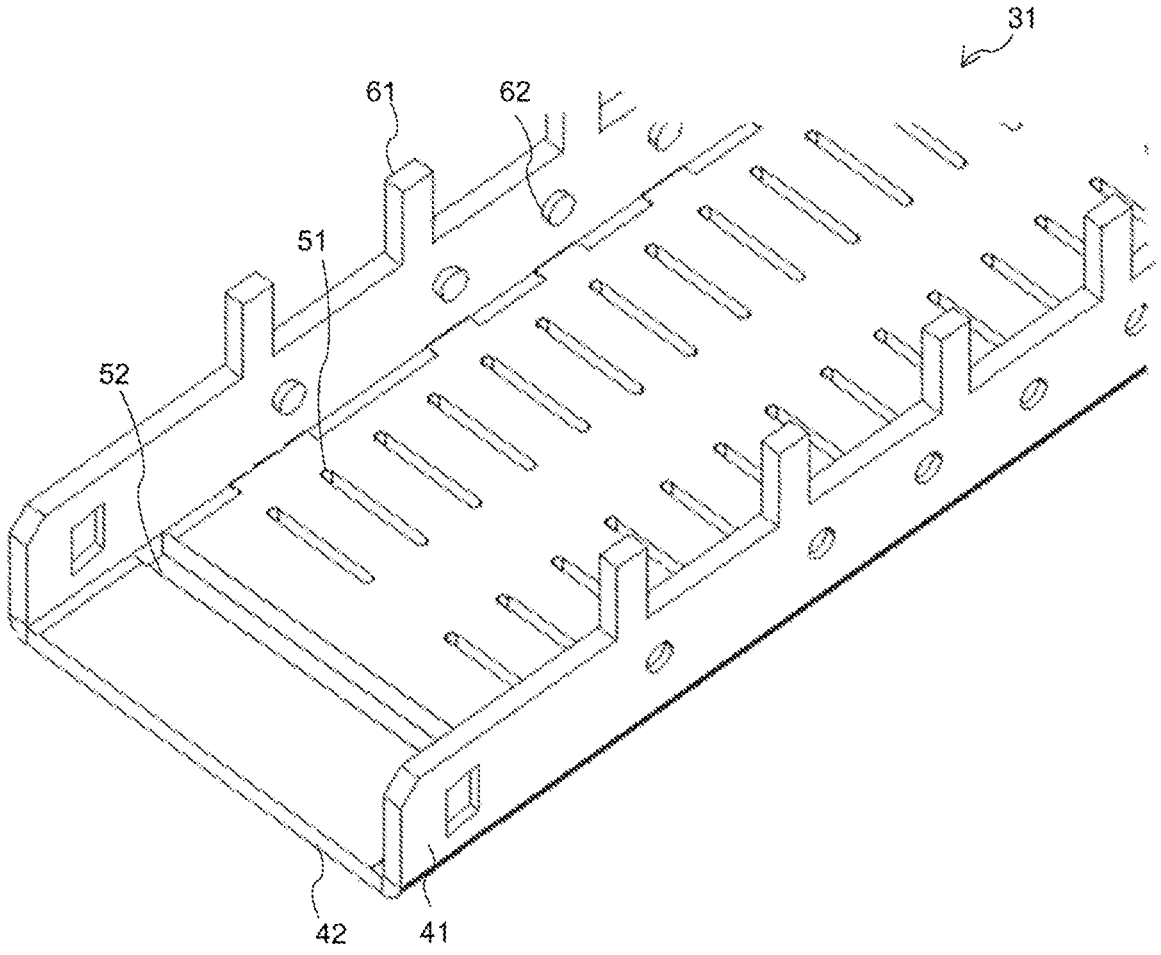
FIG. 7 is a perspective view of the base 31 according to Embodiment 1.

FIG. 6 is a perspective view of the base 31 according to Embodiment 1. FIG. 7 is a perspective view of the base 31 according to Embodiment 1. As FIG. 6 and FIG. 7 illustrate, the base 31 is a flat plate-shaped part into which the heat transfer tubes 21 are inserted. The base 31 is constituted by a bottom base 41 and a side base 42. The bottom base 41 is a plate-shaped part constituting the bottom of the base 31 and having plural insertion holes 51 and a plate hole 52. The insertion holes 51 are openings into which the end portions of the heat transfer tubes 21 are inserted. In Embodiment 1, regarding the insertion holes 51, two holes are arranged in the lateral direction and are paired. The insertion holes 51 are further arranged, in two rows, in the longitudinal direction. The plate hole 52 is an opening into which the end plate 33 is fitted. The plate hole 52 is opened substantially throughout the width of the bottom base 41 in the lateral direction. The side base 42 is a plate-shaped part constituting a side of the base 31 and extending, from an edge portion of the bottom base 41, along an edge of the corrugated sheet 32 extending in the longitudinal direction. Two side bases 42 are provided in the longitudinal direction of the heat exchanger 7. Each of the side bases 42 has plural claw portions 61 and plural catching protrusions 62.

Figure 8:
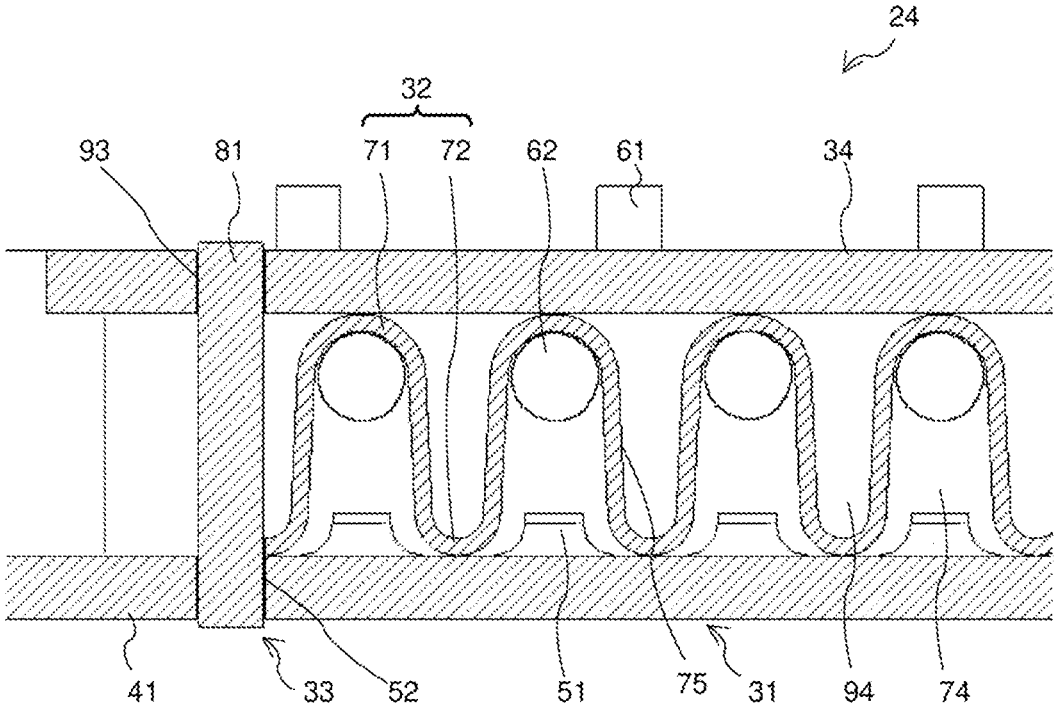
FIG. 8 illustrates the configuration of the bridging header 24 according to Embodiment 1.
Figure 9:
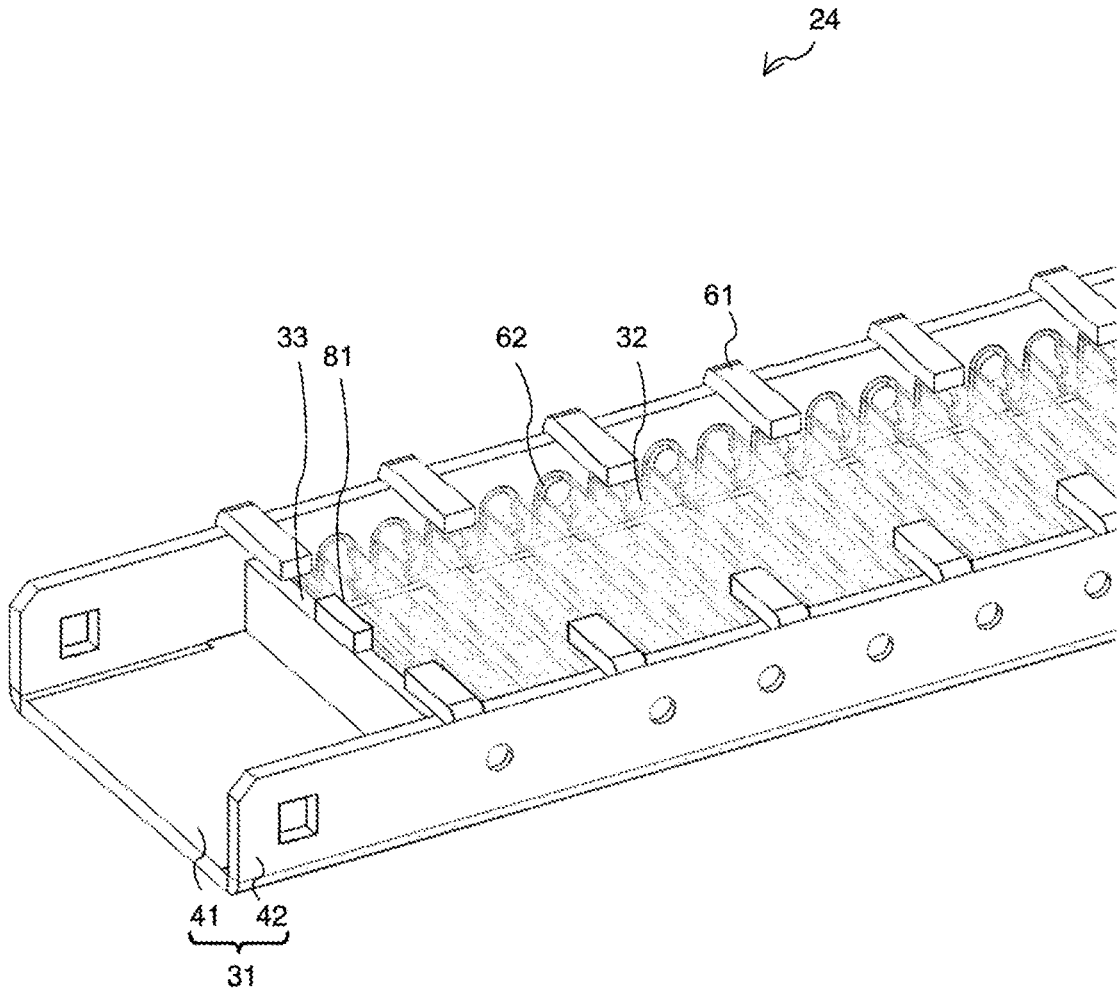
FIG. 9 is a perspective view of the bridging header 24 according to Embodiment 1.

FIG. 8 illustrates the configuration of the bridging header 24 according to Embodiment 1. FIG. 9 is a perspective view of the bridging header 24 according to Embodiment 1. FIG. 8 illustrates the section of the bridging header 24 taken in the A-A direction illustrated in FIG. 3. That is, FIG. 8 illustrates the section of the bridging header 24 taken in the longitudinal direction. Note that, in FIG. 9, the covering plate 34 is transparent, and the corrugated sheet 32 is semitransparent. As FIG. 4 and FIG. 5 illustrate, each of the claw portions 61 is a claw-shaped part protruding from an upper end portion of the side base 42 toward the covering plate 34. The claw portion 61 is in contact with a surface of the covering plate 34 facing the corrugated sheet 32 and presses the covering plate 34 toward the corrugated sheet 32. As FIG. 8 and FIG. 9 illustrates, each of the catching protrusions 62 is a substantially hollow cylindrical part protruding from an inner wall surface of the side base 42. The catching protrusions 62 catches upper end portions, in the lateral direction, crest portions 71 of the corrugated sheet 32, which will be described later. Note that the side base 42 may have no catching protrusion 62.

(Corrugated Sheet 32)

As FIG. 5 and FIG. 8 illustrate, the corrugated sheet 32 is a sheet having a shape of a wave in which the crest portions 71 and valley portions 72 are continuously formed. Each of the crest portions 71 forms an arch shape in an upper region of the corrugated sheet 32. Each of the valley portions 72 forms an arch shape in a lower region of the corrugated sheet 32. Each of the crest portions 71 covers a pair of the insertion holes 51 arranged in the lateral direction of the heat transfer tube group 20. That is, a header flow passage 74 through which refrigerant flows is formed, between each of the crest portions 71 and the base 31, for every the heat transfer tubes 21 arranged in the lateral direction of the heat transfer tube group 20. In addition, the uppermost portion of the crest portion 71 is in contact with the covering plate 34. In the longitudinal direction of the bridging header 24, the lowermost portions of the valley portions 72 are in contact with the base 31 on both sides of each of the insertion holes 51. In addition, a planar region of the corrugated sheet 32, that is, a portion of the corrugated sheet, other than the rounded portion near the peak of the crest portion 71 and the rounded portion near the peak of the valley portion 72, is referred to as a planar portion 75. The corrugated sheet 32 has plural planar portions 75 separated from one another by the rounded shapes near the peaks of the crest portions 71 and the valley portions 72.

(End Plate 33)

The end plate 33 is a flat plate-shaped part provided beside the corrugated sheet 32. The end plate 33 is fixed to the base 31 by being fitted into the plate hole 52 formed in the base 31. The end plate 33 supports a side portion of the covering plate 34. The end plate 33 has an engagement protrusion 81. The engagement protrusion 81 protrudes upward from the upper end face of the end plate 33. The engagement protrusion 81 is engaged with an engagement hole 93 of the covering plate 34, which will be described later. Note that the end plate 33 may have no engagement protrusion 81.

(Covering Plate 34)

The covering plate 34 is a flat plate-shaped part covering the corrugated sheet 32. The covering plate 34 is provided, in an upper region of the bridging header 24, between two side bases 42. In addition, the covering plate 34 presses the corrugated sheet 32 toward the base 31. Moreover, the covering plate 34 forms a cover space 94 between the covering plate 34 and the corrugated sheet 32. A side portion of the covering plate 34 has the engagement hole 93. The engagement hole 93 is an opening into which the engagement protrusion 81 of the end plate 33 is inserted.

(Second Lower Header 25)

The second lower header 25 is a header that is arranged parallel to the first lower header 23 and into which an end portion on one side of each of the heat transfer tubes 21 arranged in the second row is inserted. The refrigerant pipe 4 is connected to the second lower header 25. The second lower header 25 distributes the refrigerant that has flowed into the second lower header 25 from the refrigerant pipe 4 to the heat transfer tubes 21 arranged in the second row. The second lower header 25 also causes the refrigerant that has merged with the refrigerant flow in the second lower header 25 from the heat transfer tubes 21 arranged in the second row to flow out into the refrigerant pipe 4. Note that, regarding the heat exchanger 7, the first lower header 23 and the second lower header 25 may be formed as one body and may have, in a central portion, a partition part (not illustrated) that partitions the inner space of the first lower header 23 and the second lower header 25.

Here, a method of manufacturing the heat exchanger 7 will be described. Note that each of the base 31 of the bridging header 24, the fin 22, the first lower header 23, and the second lower header 25 is made of a clad material formed by pressure-bonding of a metal for brazing being performed. First, each of the parts of the heat exchanger 7 is formed into a predetermined shape. Here, for example, the corrugated sheet 32 is cut out as a rectangular flat plate having a predetermined size and is then processed into a wavy shape. Regarding the base 31, the insertion holes 51 and the engagement protrusions 81, for example, are formed, and the base 31 is then bent to have the bottom base 41 and the side bases 42.

Next, each of the parts of the heat exchanger 7 is assembled. Specifically, first, the corrugated sheet 32 is fitted in the base 31 of the bridging header 24. Due to such assembly, each of the crest portions 71 covers a pair of the insertion holes 51 arranged in the lateral direction, and, in the longitudinal direction of the base 31, the valley portions 72 come into contact with the base 31 on both sides of each of the insertion holes 51. Next, the end plate 33 is inserted into the plate hole 52 of the base 31. Subsequently, the covering plate 34 is attached to the base 31 so as to cover the corrugated sheet 32. At this time, the engagement protrusion 81 of the end plate 33 is inserted into the engagement hole 93 of the covering plate 34. The claw portions 61 of the side bases 42 are bent, and the bridging header 24 is thus assembled.

Furthermore, the fin 22 is provided between each two of the plural heat transfer tubes 21, and the heat transfer tubes 21 are inserted into the bridging header 124, into the first lower header 23, and into the second lower header 25. Thus, the entire heat exchanger 107 is assembled. The assembled heat exchanger 107 is then placed in a brazing apparatus and is subjected to brazing. The upper limit brazing temperature may be set at a temperature that is higher than the solidus temperature of an Al—Si alloy, which is typically used as a brazing material, and at which an Al base metal is not melted, that is, for example, a temperature higher than 580 degrees C. and lower than 630 degrees C. Due to such brazing, the clad material being subjected to pressure-bonding is melted, and each of the parts of the heat exchanger 7 is fixed. In the above-described way, the heat exchanger 7 is manufactured.

Note that the sequence of the processes of the above-described manufacturing method may be appropriately changed. For example, only the bridging header 24 may be fixed, by brazing, ahead. In addition, although the example of the base 31, of the bridging header 24, made of a clad material has been described, the end plate 33 and the covering plate 34, in addition to the base 31, may also be made of a clad material. Alternatively, only the corrugated sheet 32 may be made of a clad material. In addition to the bridging header 24, in the entire heat exchanger 7, the selection of which part is made of a clad material may be adjusted appropriately.

According to Embodiment 1, the bridging header 24 has the covering plate 34 pressing the corrugated sheet 32 toward the base 31. Thus, the corrugated sheet 32 is suppressed from being deformed by the pressure of the refrigerant flowing through the bridging header 24. That is, for suppressing the corrugated sheet 32 from being deformed by the pressure of the refrigerant flowing through the bridging header 24, the corrugated sheet 32 is not required to be thickened. Consequently, regarding the heat exchanger 7, for example, the number of the heat transfer tubes 21 that are inserted into the bridging header 24 and a space between the heat transfer tubes 21 can be adjusted, and design flexibility can thus be increased.

More specifically, the covering plate 34 presses each of the crest portions 71 of the corrugated sheet 32. Due to such pressing, the crest portions 71 are uniform in height even when tolerances on the heights of the crest portions 71 arise through the manufacturing of the corrugated sheet 32. That is, the corrugated sheet 32 has, at any point thereof, a constant strength against the refrigerant flowing through each of the header flow passages 74, thereby having less points at which the corrugated sheet 32 is likely to be broken. Thus, the heat exchanger 7 is hardly broken by the pressure of the refrigerant flowing through the bridging header 24.

In addition, according to Embodiment 1, the side base 42 has the claw portions 61. Each of the claw portions 61 is in contact with a surface of the covering plate 34 facing the corrugated sheet 32 and presses the covering plate 34 toward the corrugated sheet 32. Thus, because being further strongly pressed by the covering plate 34, the corrugated sheet 32 is further suppressed from being deformed by the pressure of the refrigerant flowing through the bridging header 24. That is, the corrugated sheet 32 is not required to be thickened. Consequently, regarding the heat exchanger 7, for example, the number of the heat transfer tubes 21 that are inserted into the bridging header 24 and a space between the heat transfer tubes 21 can be adjusted, and design flexibility can thus be increased.

Furthermore, according to Embodiment 1, the side base 42 has the catching protrusion 62. In most cases, when a corrugated sheet is long, there may be a crest portion, of the corrugated sheet, being at a position at which the crest portion does not cover an insertion hole due to tolerances, on the corrugated sheet, arising in the longitudinal direction. Here, the side base 42 of Embodiment 1 has the catching protrusion 62. Thus, with the bridging header 24, it is possible to determine accurately the position at which the corrugated sheet 32 is provided and to fix the corrugated sheet, by end portions, in the lateral direction, of the crest portion 71 being caught by the catching protrusions 62. Accordingly, the heat exchanger 7 of Embodiment 1 can be upsized when, for example, a large number of the heat transfer tubes 21 are provided, and a long corrugated sheet 32 is thus required.

Figure 10:
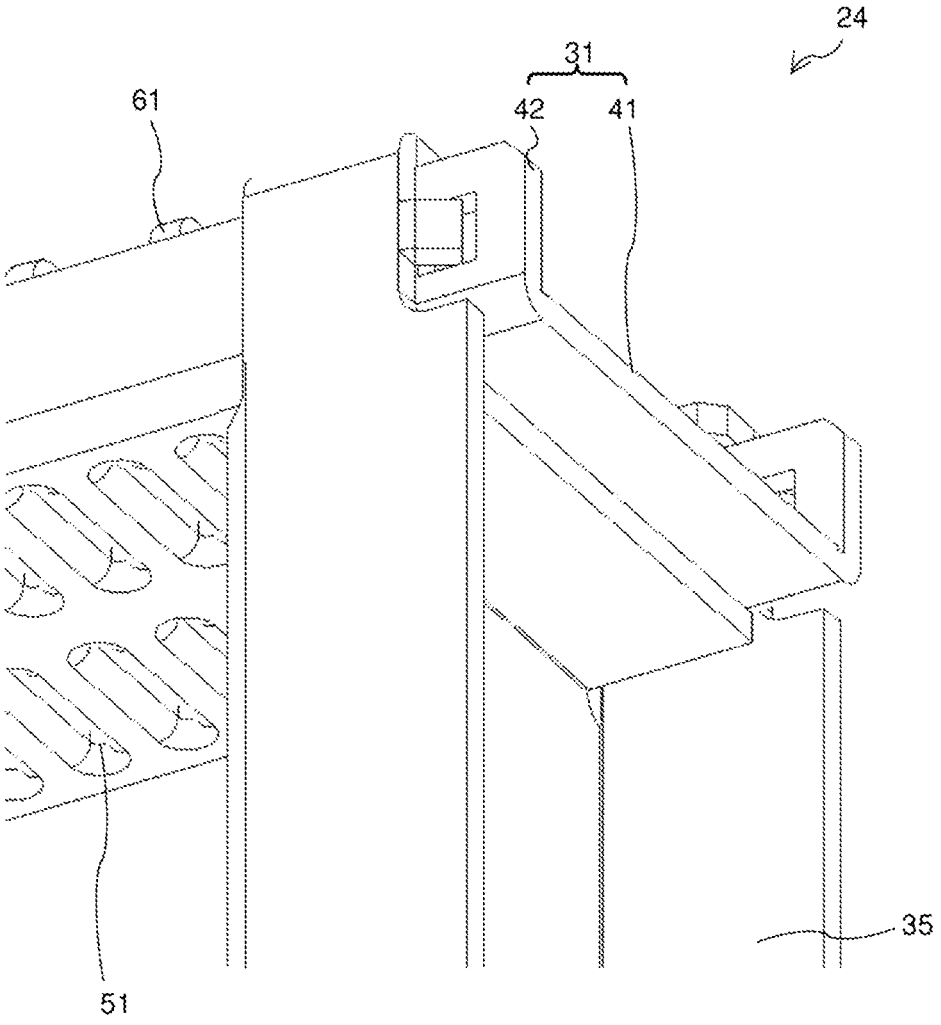
FIG. 10 is a perspective view of the bridging header 24 according to a modification of Embodiment 1.

FIG. 10 is a perspective view of the bridging header 24 according to a modification of Embodiment 1. As FIG. 10 illustrates, the bridging header 24 has a leg portion 35. The leg portion 35 is a plate-shaped part extending in the vertical direction of the heat exchanger 7 and supporting the heat exchanger 7.

Figure 11:
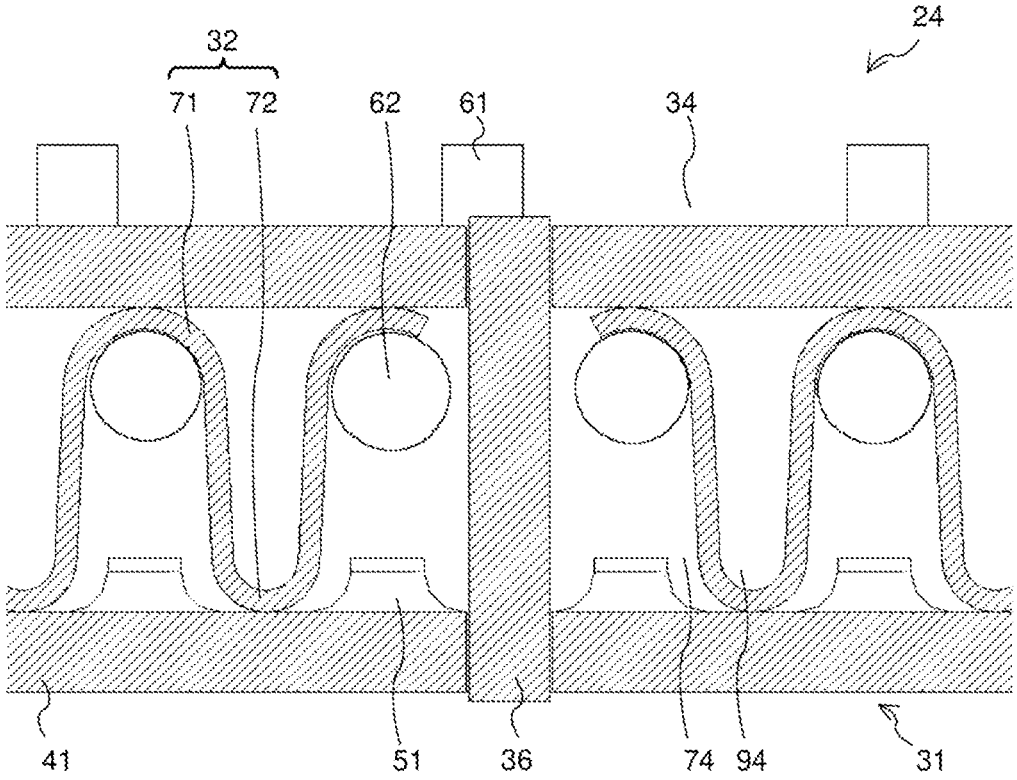
FIG. 11 illustrates the configuration of the bridging header 24 according to a modification of Embodiment 1.

FIG. 11 illustrates the configuration of the bridging header 24 according to a modification of Embodiment 1. As with FIG. 8, FIG. 11 illustrates the section of the bridging header 24 taken in the longitudinal direction. As FIG. 11 illustrates, the bridging header 24 has a partition plate 36. The partition plate 36 is a flat plate-shaped part provided in the bridging header 24 so as to partition the bridging header 24 into portions in the longitudinal direction. Note that two or more partition plates 36 may be provided. The partition plate 36 separates the flow of the refrigerant on one side of the partition plate 36 from the flow of the refrigerant on the other side of the partition plate 36. In addition, the partition plate 36 has a thickness large enough not to be deformed even when there is a large difference in pressure between the refrigerants on one side and on the other side of the partition plate 36. Thus, in regions on both sides of the partition plate 36, the heat exchanger 7 can cause the refrigerants having different pressures to flow without the corrugated sheet 32 being deformed, as with the case where plural refrigerant pipes 4 constituting different refrigerant circuits are connected.

Embodiment 2

Figure 12:
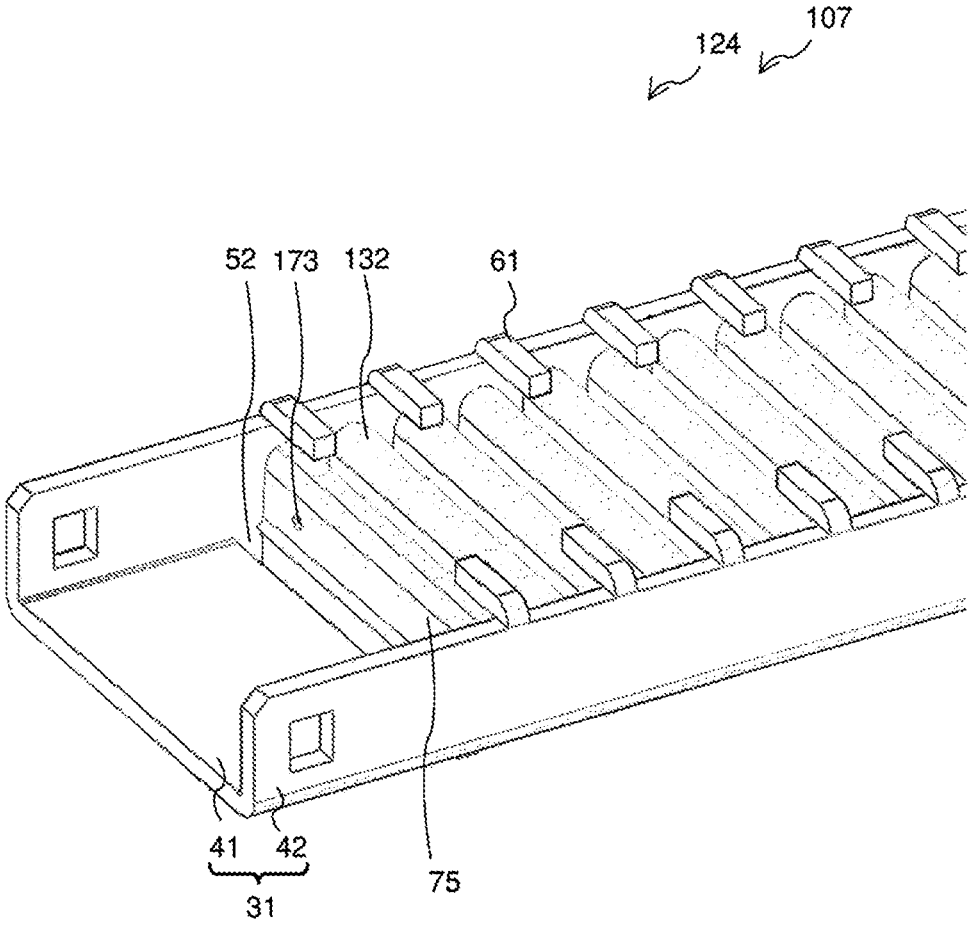
FIG. 12 is a perspective view of a bridging header 124 according to Embodiment 2.

FIG. 12 is a perspective view of a bridging header 124 according to Embodiment 2. Note that, in FIG. 12, a covering plate 134 is transparent for an illustration purpose. Embodiment 2 differs from Embodiment 1 in that a corrugated sheet 132 has a corrugated-sheet hole 173 as FIG. 12 illustrates. In Embodiment 2, by the same parts as the parts of Embodiment 1 being denoted by the same references, the description thereof will be omitted, and differences from Embodiment 1 will be mainly described.

(Bridging Header 124)

Figure 13:
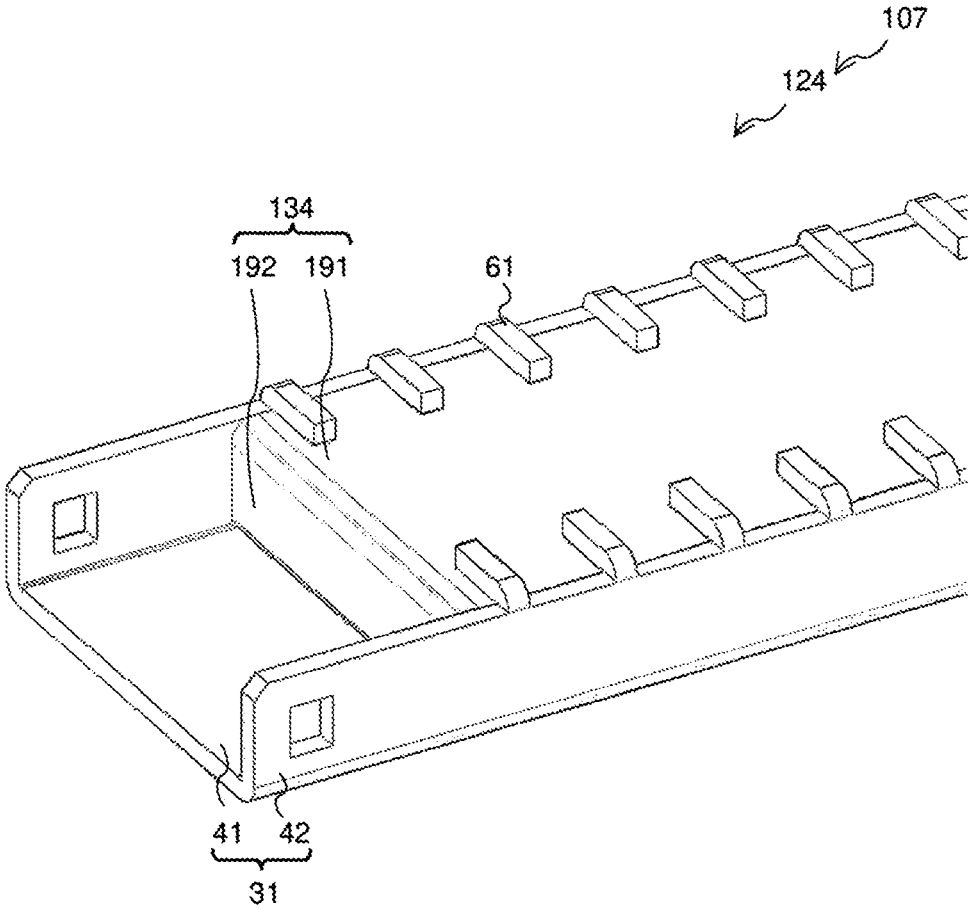
FIG. 13 is a perspective view of the bridging header 124 according to Embodiment 2.
Figure 14:
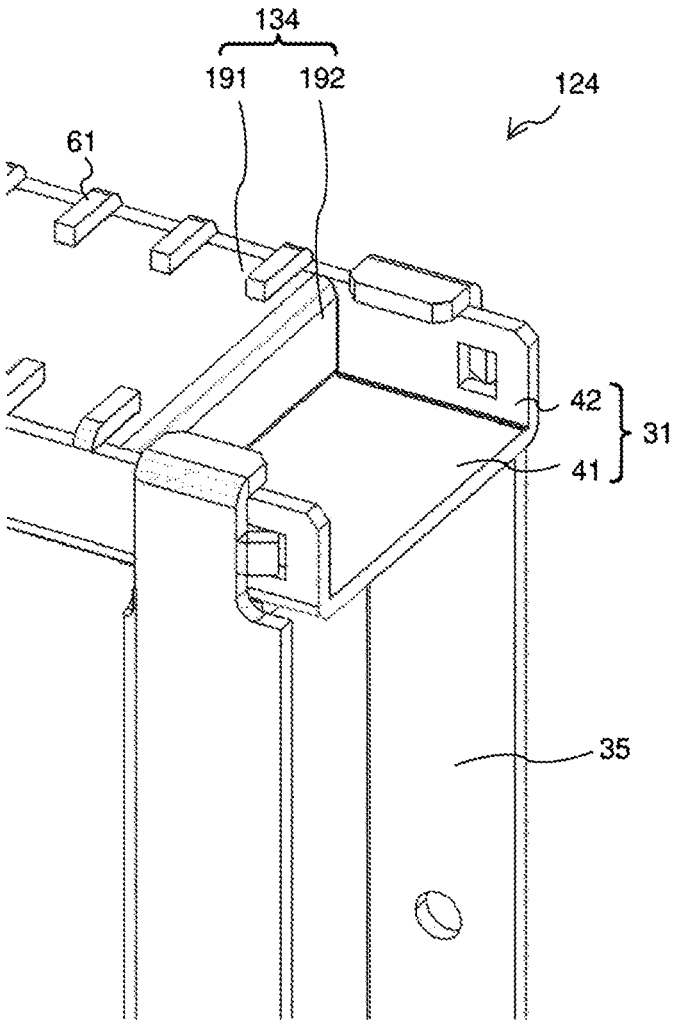
FIG. 14 is a perspective view of the bridging header 124 according to Embodiment 2.

FIG. 13 is a perspective view of the bridging header 124 according to Embodiment 2. FIG. 14 is a perspective view of the bridging header 124 according to Embodiment 2. As FIGS. 12 to 14 illustrate, the bridging header 124 has a base 131, the corrugated sheet 132, and the covering plate 134. The bridging header 124 has no end plate. Note that the bridging header 124 may have an end plate 33.

(Corrugated Sheet 132)

Figure 15:
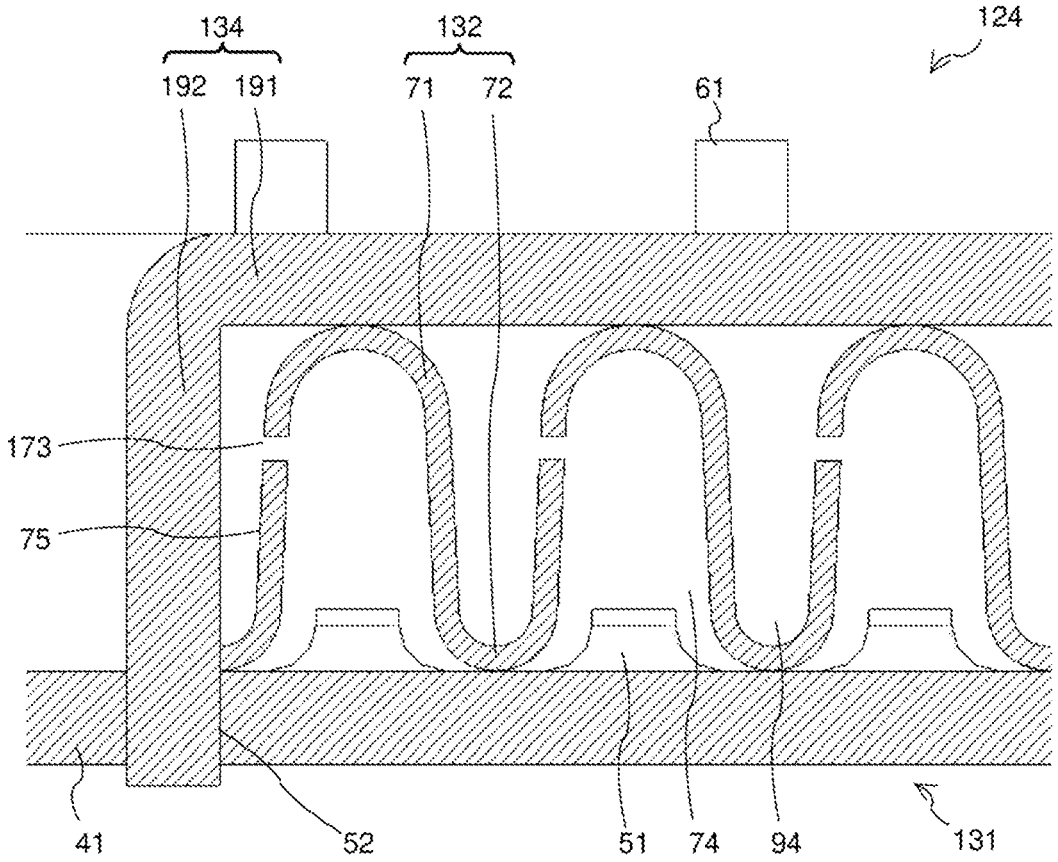
FIG. 15 illustrates the configuration of the bridging header 124 according to Embodiment 2.

FIG. 15 illustrates the configuration of the bridging header 124 according to Embodiment 2. As with FIG. 8 and FIG. 11, FIG. 15 illustrates the section of the bridging header 124 taken in the longitudinal direction. As FIG. 12 and FIG. 15 illustrate, each of the planar portions 75 of the corrugated sheet 132 has the corrugated-sheet hole 173. The corrugated-sheet hole 173 is an opening through which refrigerant flows between the header flow passage 74 and the cover space 94. Thus, the cover space 94 is filled with the refrigerant that has flowed out from the header flow passage 74 through the corrugated-sheet hole 173. In addition, the header flow passage 74 is filled with the refrigerant flowing between the heat transfer tubes 21 facing one another in the lateral direction. That is, with the corrugated-sheet hole 173, the refrigerants in the header flow passage 74 and in the cover space 94 have uniform pressure. Note that the size of the corrugated-sheet hole 173 is set within a range in which the corrugated-sheet hole 173 is not closed by a molten metal when the fixation of a heat exchanger 107 is performed by brazing.

(Covering Plate 134)

The covering plate 134 is constituted by an upper covering plate 191 and a side covering plate 192. The upper covering plate 191 is a plate covering the upper side of the corrugated sheet 132. The upper covering plate 191 presses the corrugated sheet 132 toward the base 131. The side covering plate 192 is a plate covering a side portion of the corrugated sheet 132. The side covering plate 192 is fixed to the base 131 by being fitted into the plate hole 52 formed in the base 131. That is, the side covering plate 192 has a function similar to the function of the end plate 33 of Embodiment 1. Note that the covering plate 134 may be constituted by only the upper covering plate 191 when the bridging header 124 has an end plate 33.

Figure 16:
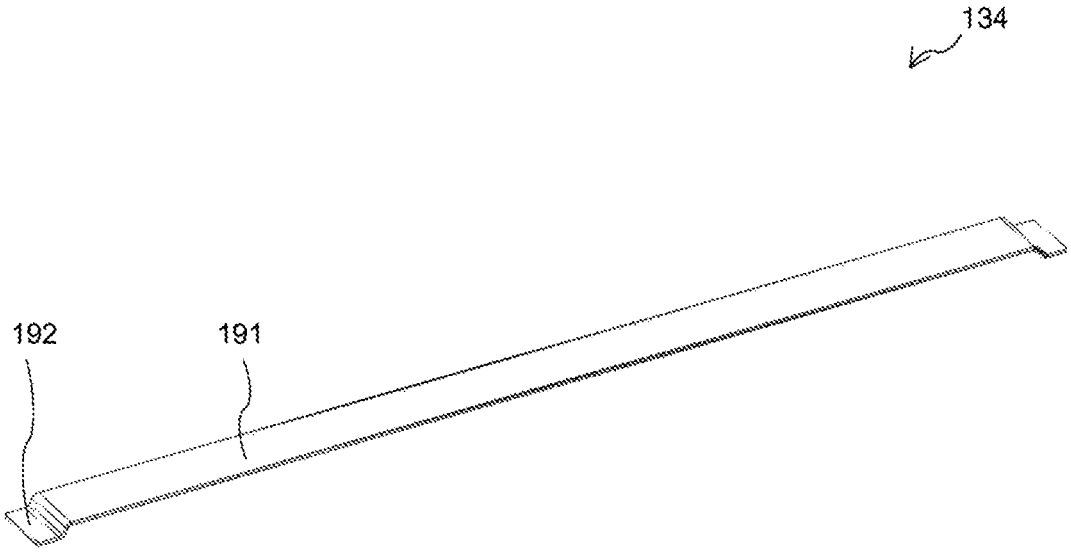
FIG. 16 is a perspective view of covering plate 134 according to Embodiment 2.
Figure 17:
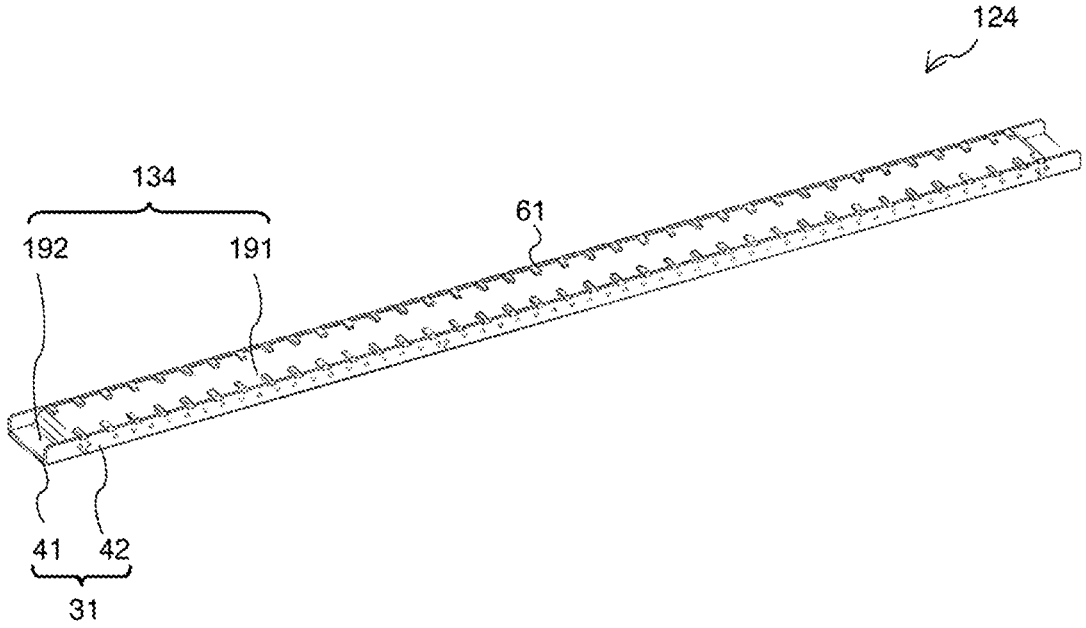
FIG. 17 is a perspective view of the bridging header 124 according to Embodiment 2.

FIG. 16 is a perspective view of the covering plate 134 according to Embodiment 2. FIG. 17 is a perspective view of the bridging header 124 according to Embodiment 2. As FIG. 16 and FIG. 17 illustrate, the covering plate 134 may have a shape elongated toward end portions, in the longitudinal direction, of the bridging header 124. In this case, in the heat exchanger 107, the base 131 and the covering plate 134 can be fixed to one another regardless of the thickness of the covering plate 134.

According to Embodiment 2, the corrugated sheet 132 has the corrugated-sheet hole 173. Thus, the cover space 94 is filled with the refrigerant that has flowed out from the header flow passage 74 through the corrugated-sheet hole 173. In addition, the header flow passage 74 is filled with the refrigerant flowing between the heat transfer tubes 21 facing one another in the lateral direction. That is, the refrigerants in the header flow passage 74 and in the cover space 94 have uniform pressure. Thus, the corrugated sheet 132 is further suppressed from being deformed by the pressure of the refrigerant flowing through the header flow passage 74 and is thus not required to be thickened. Consequently, regarding the heat exchanger 107, for example, the number of the heat transfer tubes 21 that are inserted into the bridging header 124 and a space between the heat transfer tubes 21 can be adjusted, and design flexibility can thus be increased.

Embodiment 3

Figure 18:
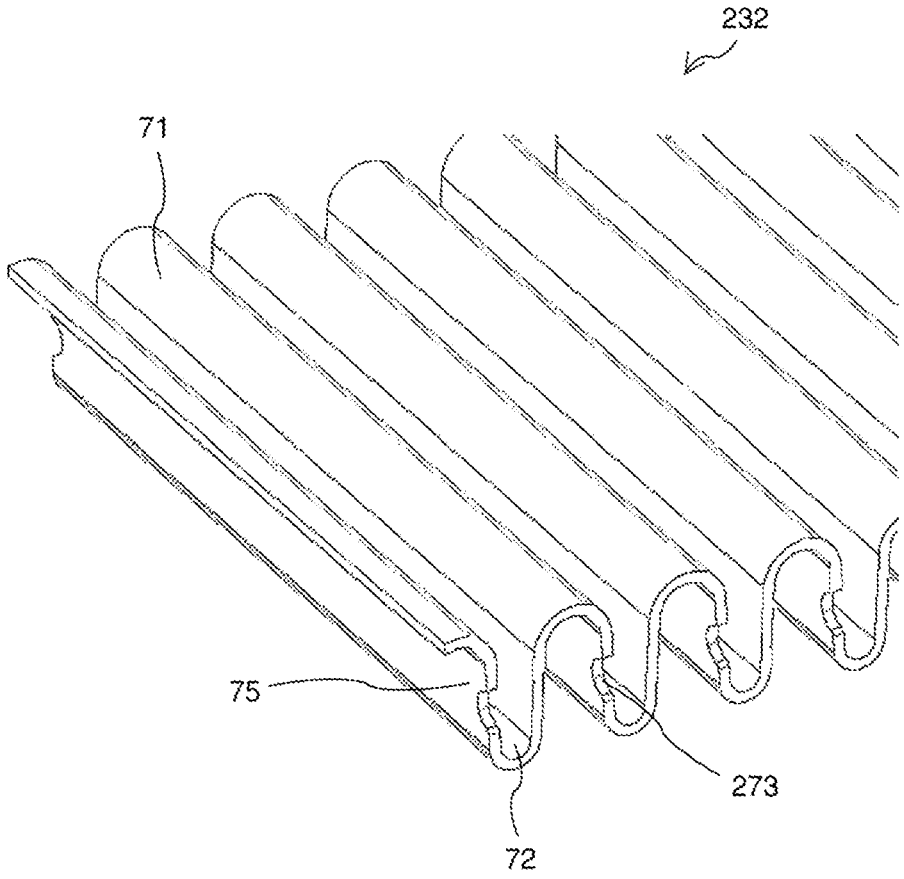
FIG. 18 is a perspective view of corrugated sheet 232 according to Embodiment 3.

FIG. 18 is a perspective view of a corrugated sheet 232 according to Embodiment 3. Embodiment 3 differs from Embodiment 1 in that a corrugated-sheet hole 273 is formed in an end portion, in the lateral direction, of the corrugated sheet 232 as FIG. 18 illustrates. In Embodiment 3, by the same parts as the parts of Embodiment 1 being denoted by the same references, the description thereof will be omitted, and differences from Embodiment 1 will be mainly described.

(Corrugated Sheet 232)

The corrugated-sheet hole 273 has a semicircular shape and is formed at each of both the end portions of the corrugated sheet 232 in the lateral direction. Thus, for example, a portion of the refrigerant flowing through the header flow passage 74 flows out from the corrugated-sheet hole 273 positioned on one side and flows into the cover space 94, and a portion of the refrigerant flowing through the cover space 94 flows out from the corrugated-sheet hole 273 positioned on the other side and flows into the header flow passage 74. That is, the refrigerant circulates between the header flow passage 74 and the cover space 94. Thus, the refrigerants in the header flow passage 74 and in the cover space 94 have further uniform pressure.

Figure 19:
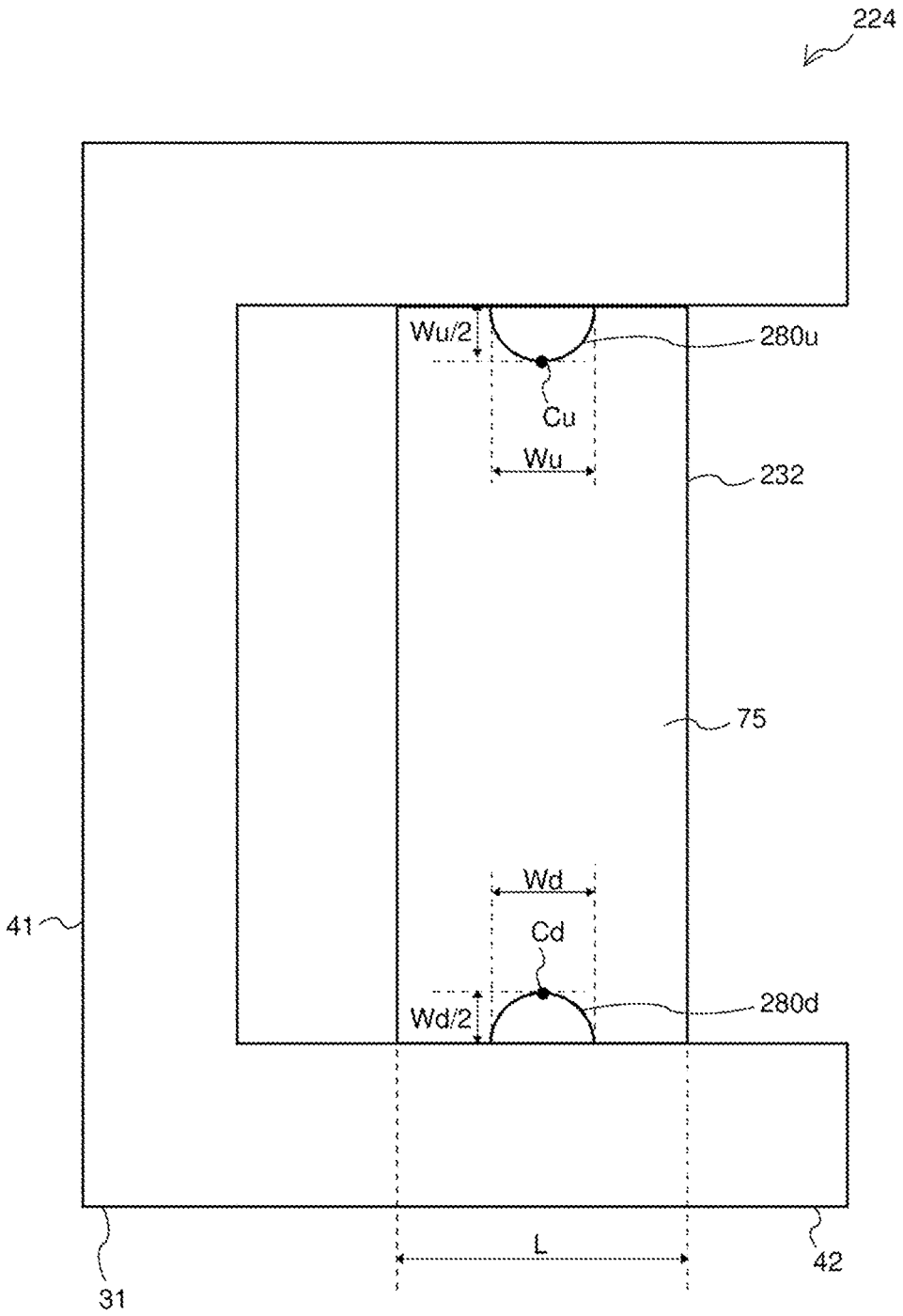
FIG. 19 illustrates a method of manufacturing a heat exchanger 207 according to Embodiment 3.

FIG. 19 illustrates a method of manufacturing a heat exchanger 207 according to Embodiment 3. FIG. 19 illustrates a bridging header 224 when the bridging header 224 is viewed in the longitudinal direction. In addition, FIG. 19 illustrates, for simple description, only the bottom base 41, the side base 42, and the corrugated sheet 232 are illustrated. The base 31 is a clad material, and a brazing material is pressure-bonded to an inner surface of the side base 42, that is, a surface to be in contact with the corrugated sheet 232. In Embodiment 3, as FIG. 19 illustrates, the bridging header 224 is disposed so that the side bases 42 are positioned above and below across the corrugated sheet 232, and brazing is performed.

In addition, a corrugated-sheet hole 271 before brazing is referred to as a before-heating hole. That is, the corrugated-sheet hole 271 is a hole into which the before-heating hole is deformed by the brazing of the bridging header 224. Hereinafter, a preferable dimension of the before-heating hole that is applicable in Embodiment 3 will be described. The before-heating hole is processed, for example, at the same time as uniformization of the length, in the lateral direction, of the corrugated sheet 232. The before-heating hole is formed in each of the upper region and the lower region of the corrugated sheet 232 and has a semicircular shape. When a distinction between the before-heating hole on the upper side and the before-heating hole on the lower side is required to be made, in the description, different references denote the before-heating holes, that is, the lower hole is referred to as a before-heating hole 280*d*, and the upper hole is referred to as a before-heating hole 280*u*. The width of the lower before-heating hole 280*d*, that is, the width of a region in which the corrugated sheet 232 and the side base 42 on the lower side are not in contact with one another is referred to as a width Wd. Because the before-heating hole 280*d* has a semicircular shape, the distance from the side base 42 on the lower side to the outer edge of the lower before-heating hole 280*d* reaches a maximum distance of Wd/2 at a central portion Cd of the outer edge. Similarly, the width of the upper before-heating hole 280*u*, that is, the width of a region in which the corrugated sheet 232 and the side base 42 on the upper side are not in contact with one another is referred to as a width Wu. Because the before-heating hole 280*u* has a semicircular shape, the distance from the side base 42 on the upper side to the outer edge of the upper before-heating hole 280*u* reaches a maximum distance of Wu/2 at a central portion Cu of the outer edge.

Figure 20:
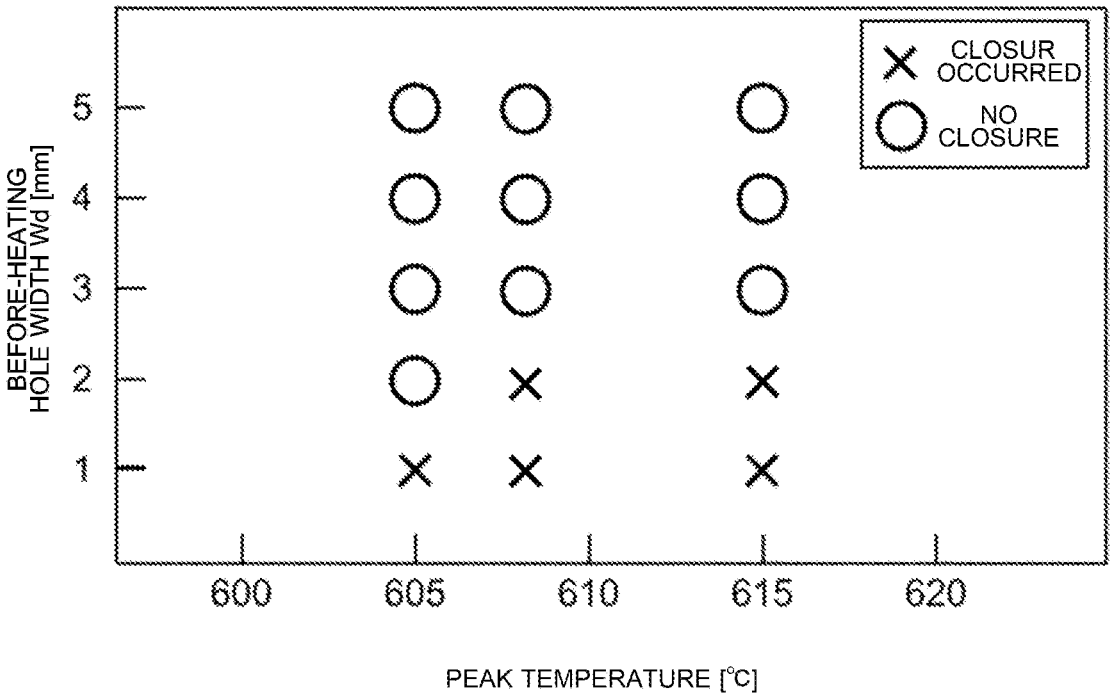
FIG. 20 illustrates the presence or absence of closure of a before-heating hole 280*d* on the lower side caused by brazing according to Embodiment 3, for each of the widths Wd of the before-heating holes and for each of the peak temperatures.
Figure 21:
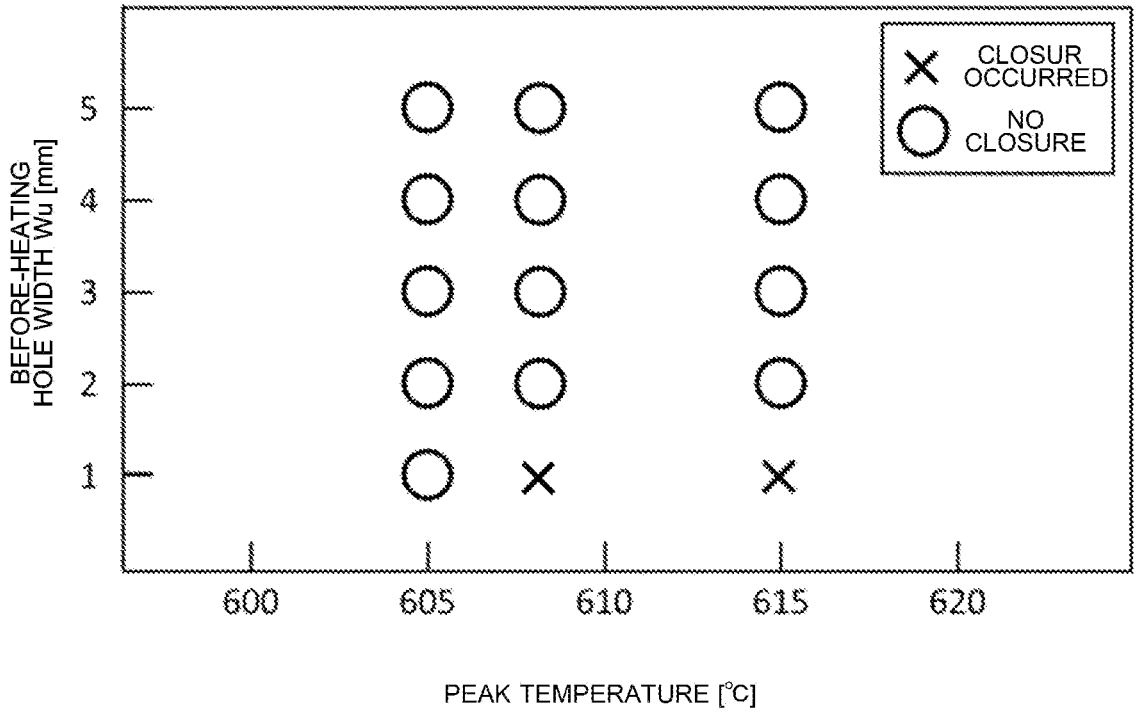
FIG. 21 illustrates the presence or absence of closure of a before-heating hole 280*u* on the upper side caused by brazing according to Embodiment 3, for each of the widths Wu of the before-heating holes and for each of the peak temperatures.

Here, the presence or absence of closure of the before-heating hole caused by brazing will be described. Typically, in brazing, a molten brazing material flows into and fill the before-heating hole, and the before-heating hole may thereby be closed. FIG. 20 illustrates the presence or absence of closure of the before-heating hole 280*d* on the lower side caused by brazing according to Embodiment 3, for each of the widths Wd of the before-heating holes and for each of the peak temperatures. Similarly, FIG. 21 illustrates the presence or absence of closure of the before-heating hole 280*u* on the upper side caused by brazing according to Embodiment 3, for each of the widths Wu of the before-heating holes and for each of the peak temperatures. In FIG. 20 and FIG. 21, as FIG. 19 illustrates, the presence or absence of closure of the before-heating hole when brazing is performed with the side bases 42 of clad material being positioned above and below the corrugated sheet 232 is verified for each of the widths of the before-heating holes and for each of the peak temperatures, and the presence or absence of closure of the before-heating hole is plotted. FIG.

20 illustrates the case of the lower before-heating hole 280*d*, and FIG. 21 illustrates the case of the upper before-heating hole 280*u*.

As FIG. 20 and FIG. 21 illustrate, it has been found that even a before-heating hole whose width W is larger is closed as the peak temperature of brazing is increased. It has also been found that there is a difference in a width with which an opening is closed, between the upper before-heating hole and the lower before-heating hole. Specifically, when heating is performed at the same peak temperature, in the case of the lower before-heating hole 280*d*, closure occurs in a before-heating hole whose width Wd is larger, compared with the case of the upper before-heating hole 280*u*. The difference between the cases is caused by an incident in which, when the molten clad material flowing, by gravitation, along the corrugated sheet 232, the molten clad material flows into the lower before-heating hole 280*d* formed at a position below the upper before-heating hole 280*u*.

Figure 22:
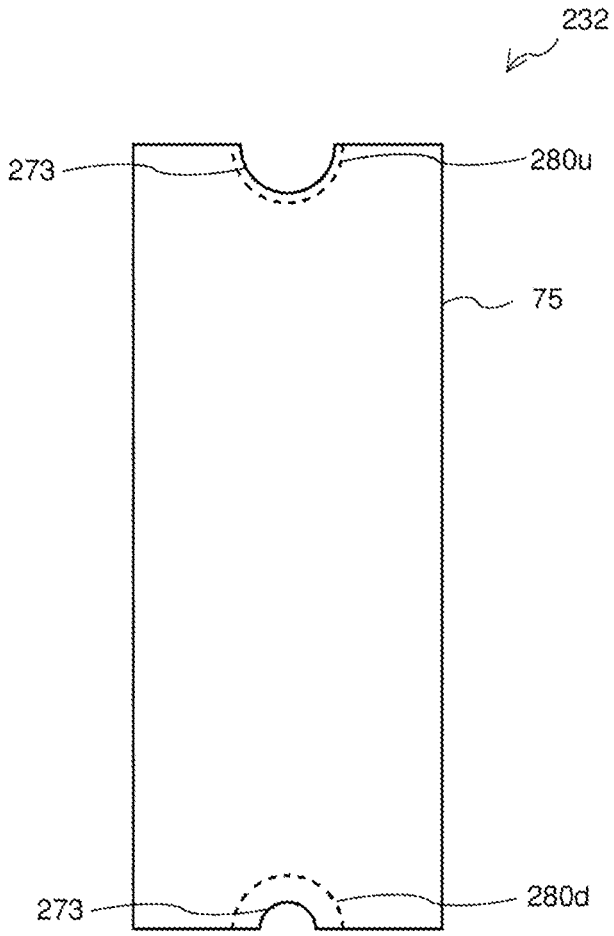
FIG. 22 is a side view of the corrugated sheet 232 after brazing according to Embodiment 3.

FIG. 22 is a side view of the corrugated sheet 232 after brazing according to Embodiment 3. FIG. 22 illustrates the corrugated sheet 232 when the corrugated sheet 232 is viewed in the longitudinal direction. The broken line represents a before-heating hole. As FIG. 22 illustrates, even when before-heating holes having the same width are formed in two end portions, in the lateral direction, of the corrugated sheet 232 before brazing, the corrugated-sheet holes 273 after brazing have different widths depending on the orientation of the bridging header 224 during brazing. That is, viewing such a matter from a different angle, the before-heating hole 280*u* positioned on the upper side during brazing is hardly closed even when having a width Wu smaller than the width of the before-heating hole 280*d* positioned on the lower side. Specifically, as FIG. 20 and FIG. 21 illustrate, regarding the upper before-heating hole 280*u*, the width Wu has room for reduction by 1 mm to reach a width with which closure is caused, compared with the lower before-heating hole 280*d* that is brazed at the same peak temperature. Thus, for example, the width Wu of the before-heating hole 280*u* positioned on the upper side may be 1 mm smaller than the width of the before-heating hole 280*d* positioned on the lower side.

Moreover, as FIG. 21 illustrates, even the lower before-heating hole 280*d* that is likely to be closed is suppressed from being closed when a width of 1 mm is ensured. In addition, the before-heating hole is formed in the planar portion 75 so as not to extend over a rounded portion of the corrugated sheet 232. Thus, where L is a dimension, in the lateral direction, of the planar portion 75 of the corrugated sheet 232, the before-heating hole can be within the range from 1 mm to L—processing tolerance mm. The processing tolerance is, for example, 0.5 mm.

According to Embodiment 3, the corrugated-sheet holes 273 are formed in both the end portions, in the lateral direction, of the corrugated sheet 232. Thus, for example, a portion of the refrigerant flowing through the header flow passage 74 flows out from the corrugated-sheet hole 273 positioned on one side and flows into the cover space 94, and a portion of the refrigerant flowing through the cover space 94 flows out from the corrugated-sheet hole 273 positioned on the other side and flows into the header flow passage 74. That is, the refrigerant circulates between the header flow passage 74 and the cover space 94, and the pressure of the refrigerant is further maintained uniform. Thus, the corrugated sheet 232 is further suppressed from being deformed by the pressure of the refrigerant flowing through the header flow passage 74 and is thus not required to be thickened. Consequently, regarding the heat exchanger 207, for example, the number of the heat transfer tubes 21 that are inserted into the bridging header 224 and a space between the heat transfer tubes 21 can be adjusted, and design flexibility can thus be increased.

In addition, the corrugated-sheet hole 273 may be processed at the same time as the processing performed when the length, in the lateral direction, of the corrugated sheet 232 is uniformized. In this case, regarding the heat exchanger 207, the time and effort for processing can be reduced.

According to the method of manufacturing the heat exchanger 207 of Embodiment 3, the width Wu of the before-heating hole 280*u* positioned on the upper side during brazing is smaller than the width Wd of the before-heating hole 280*d* positioned on the lower side during brazing. Thus, while the before-heating holes can be suppressed from being closed after brazing, the bonding area between the corrugated sheet 232 and the side base 42 can be ensured, and the bonding strength between the corrugated sheet 232 and the base 31 can thus be suppressed from being decreased.

In addition, according to the method of manufacturing the heat exchanger 207 of Embodiment 3, the before-heating hole can be formed within the range from 1 mm to L—processing tolerance mm. Thus, while the before-heating holes can be suppressed from being closed after brazing, the bonding area between the corrugated sheet 232 and the side base 42 can be ensured, and the bonding strength between the corrugated sheet 232 and the base 31 can thus be suppressed from being decreased.

Embodiment 4

Figure 23:
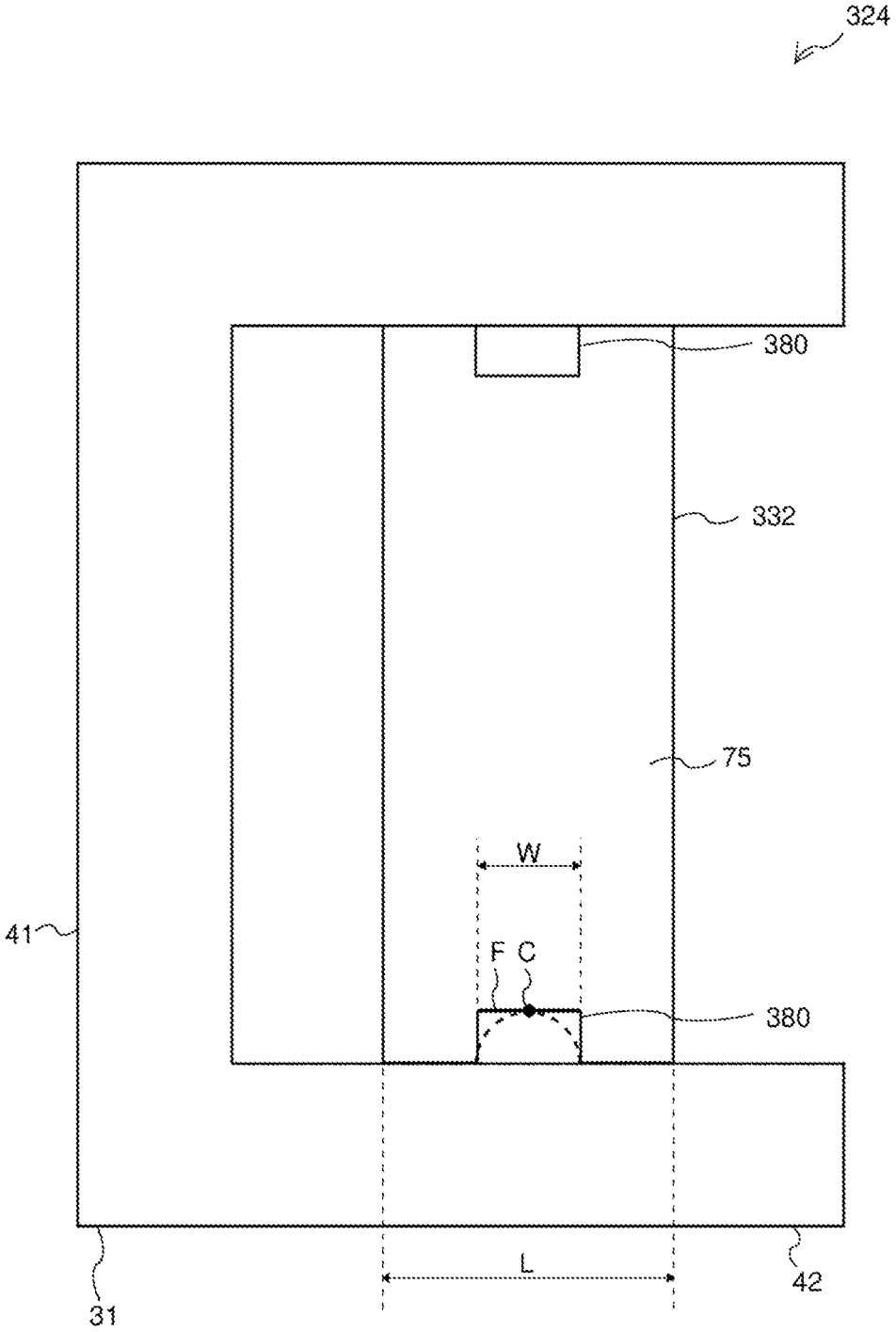
FIG. 23 illustrates a method of manufacturing a heat exchanger 307 according to Embodiment 4.

FIG. 23 illustrates a method of manufacturing a heat exchanger 307 according to Embodiment 4. FIG. 23 illustrates a bridging header 324 when the bridging header 324 is viewed in the longitudinal direction. The method of manufacturing the heat exchanger 307 of Embodiment 4 differs from the method of manufacturing the heat exchanger of Embodiment 3 in that a corrugated sheet 332 has a before-heating hole 380 having a rectangular shape as FIG. 23 illustrates. In Embodiment 4, by the same parts as the parts of Embodiment 3 being denoted by the same references, the description thereof will be omitted, and differences from Embodiment 3 will be mainly described.

As FIG. 23 illustrates, in Embodiment 4, the before-heating hole 380 has a rectangular shape. Note that, although, in FIG. 23, the bridging header 324 is disposed so that the side bases 42 are positioned above and below across the corrugated sheet 332, the orientation of the bridging header 324 is not limited during brazing in the method of manufacturing the heat exchanger 307 of Embodiment 4. In most cases, in brazing, a molten brazing material forms a fillet along the outer edge of the before-heating hole 380 so as to fill the before-heating hole 380 with a contact point between the outer edge of the before-heating hole 380 and the side base 42 being a starting point. Typically, when a molten metal flows into a space between different parts, the smaller the space therebetween is, the more easily the molten metal fills the space due to capillary force. Similarly, the narrower the space between the outer edge of the before-heating hole 380 and the side base 42 is, the more the brazing material fills the before-heating hole 380; thus, the before-heating hole 380 is likely to be closed.

For example, as the broken line in FIG. 23 illustrates, when the before-heating hole has a semicircular shape, the space between the outer edge of the before-heating hole 380 and the side base 42 reaches a maximum size only at a central portion C of the outer edge of the before-heating hole 380. In contrast thereto, as in Embodiment 4, when the before-heating hole 380 has a rectangular shape, the space between the outer edge of the before-heating hole 380 and the side base 42 reaches a maximum size at any point along a side F, of the outer edge of the before-heating hole 380, facing the inner surface of the side base 42. Thus, regarding the case of the rectangular before-heating hole 380, the space between the before-heating hole 380 and the side base 42 can be widened as a whole compared with the case of the semicircular before-heating hole when the width of the before-heating hole 380 is the same in both the cases, and the maximum space between the before-heating hole 380 and the side base 42 is the same between both the cases.

Note that, where L is a dimension of the planar portion 75 of the corrugated sheet 332, the width W of the rectangular before-heating hole 380 can be within the range from 1 mm to L—processing tolerance mm, as with the diameter of the semicircular before-heating hole 380 in Embodiment 3. The processing tolerance is, for example, 0.5 mm.

According to the method of manufacturing the heat exchanger 307 of Embodiment 4, the space between the before-heating hole 380 and the side base 42 can be widened as a whole by the before-heating hole 380 being formed into a rectangular shape. Thus, while the before-heating hole 380 can be suppressed from being closed after brazing, the bonding area between the corrugated sheet 232 and the side base 42 can be ensured, and the bonding strength between the corrugated sheet 232 and the base 31 can thus be suppressed from being decreased.

Embodiment 5

Figure 24:
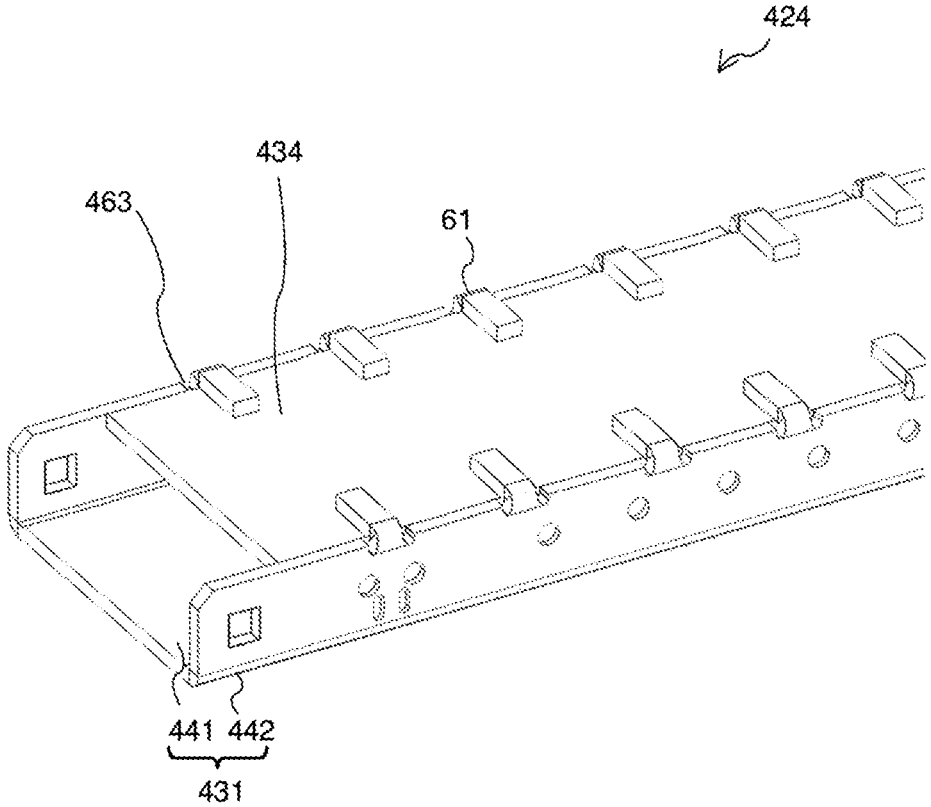
FIG. 24 is a perspective view of a bridging header 424 according to Embodiment 5.
Figure 25:
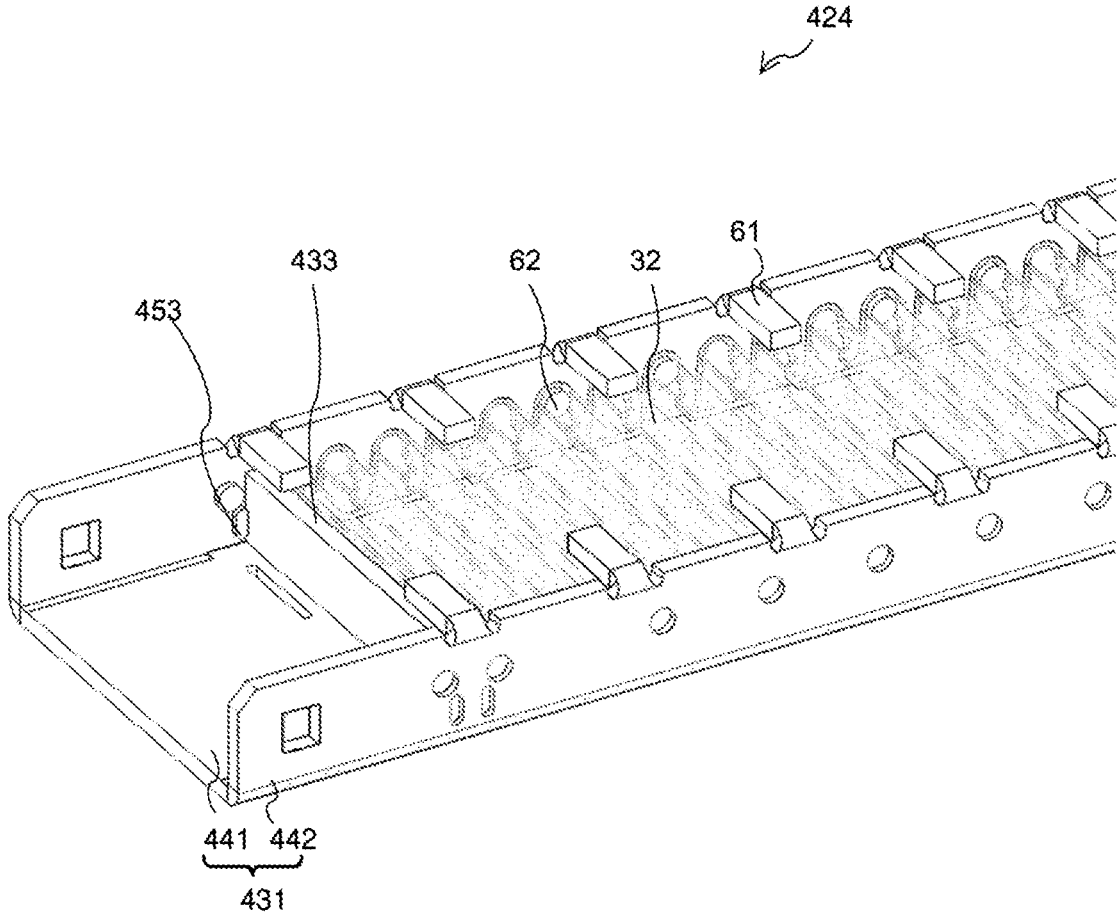
FIG. 25 is a perspective view of the bridging header 424 according to Embodiment 5.
Figure 26:
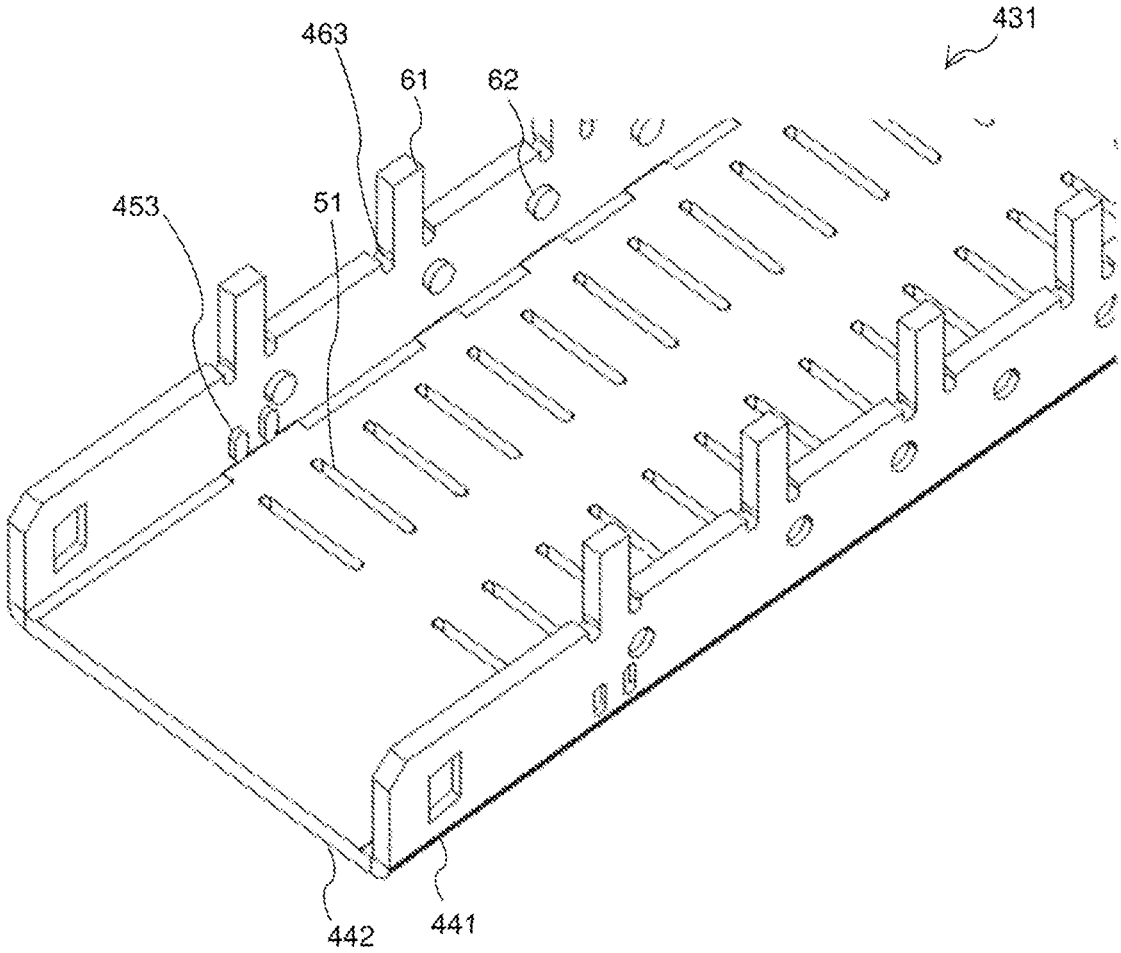
FIG. 26 is a perspective view of a base 431 according to Embodiment 5.

FIG. 24 is a perspective view of a bridging header 424 according to Embodiment 5. FIG. 25 is a perspective view of the bridging header 424 according to Embodiment 5. Note that, in FIG. 25, a covering plate 434 is transparent, and the corrugated sheet 32 is semitransparent. FIG. 26 is a perspective view of a base 431 according to Embodiment 5. Embodiment 5 differs from Embodiment 1 in that the base 431 has a cutout 463 as FIGS. 24 to 26 illustrate. In Embodiment 5, by the same parts as the parts of Embodiment 1 being denoted by the same references, the description thereof will be omitted, and differences from Embodiment 1 will be mainly described.

A heat exchanger 407 of Embodiment 5 is provided in the outdoor unit 2 so that, for example, a bottom base 441 serves as the lower side of the base 431. As FIGS. 24 to 26 illustrate, a side base 442 of Embodiment 5 has the cutouts 463 having a semicircular shape on both sides of each of the claw portions 61. The depth of each of the cutouts 463 is adjusted so that a lower end portion of the cutout 463 is positioned below the upper surface of the covering plate 434.

In most cases, during brazing, when the upper surface of the covering plate 434 is provided at a position below the upper end face of the side base 442, rainwater, for example, that has showered down on the upper surface of the covering plate 434 is obstructed by the side base 442, thereby not being drained; thus, such rainwater may remain thereon to be accumulated. In this case, the water retained on the upper surface of the covering plate 434 may corrode the bridging header 424. In contrast thereto, in Embodiment 5, the provided cutouts 463 help to remove the retained water and suppress the bridging header 424 from being corroded.

Alternatively, when the side base 442 is provided at a position lower than the upper surface of the covering plate 434 throughout the length of the side base 442 for placing priority on drainage, the contact surface between the base 431 and the covering plate 434 cannot be sufficiently ensured, and insufficient brazing may be caused. In this case, the pressure resistance of the bridging header 424 may be decreased. In contrast thereto, in Embodiment 5, the cutouts 463 are provided only beside both sides of the claw portion 61, and the pressure resistance and the drainage properties of the bridging header 424 can thereby be compatible with one another.

Furthermore, each of the plural claw portions 61 of the side base 442 is bent at the base thereof for pressing the covering plate 434 toward the corrugated sheet 32. At this point, the bending workability of the claw portion 61 is improved by the cutouts 463 being provided beside both sides of the claw portions 61.

In addition, the side base 442 has plural plate-catching portions 453. On both end portions, in the longitudinal direction, of the side base 442, two plate-catching portions 453 are provided per end portion and protrude from the inner wall surface of the side base 442. In addition, the bottom base 441 has no plate hole into which an end plate 433 is fitted. In Embodiment 5, the end plate 433 is fixed by an end of the end plate 433 being held between the two plate-catching portions 453. In this case also, regarding the bridging header 424, the end plate 433 can be fixed while a pressure resistance on per with the pressure resistance when the end plate 433 is fitted into the plate hole 52 of Embodiment 1 is ensured.

The above-described embodiments and modifications may be appropriately combined with one another without departing from the spirit of the present disclosure. For example, the plate-catching portion 453 of Embodiment 5 may be provided for the base 31 of Embodiment 1 as a substitute for a part of the base 31 or as an additional part to the base 31. In addition, the cutout 463 of Embodiment 5 may be formed in the base of any one of Embodiments 2 to 4.

REFERENCE SIGNS LIST

1: air-conditioning apparatus, 2: outdoor unit, 3: indoor unit, 4: refrigerant pipe, 5: compressor, 6: flow-switching device, 7: heat exchanger, 8: outdoor fan, 9: expansion unit, 11: indoor heat exchanger, 12: indoor fan, 20: heat transfer tube group, 21: heat transfer tube, 22: fin, 23: first lower header, 24: bridging header, 25: second lower header, 31: base, 32: corrugated sheet, 33: end plate, 34: covering plate, 35: leg portion, 36: partition plate, 41: bottom base, 42: side base, 51: insertion hole, 52: plate hole, 61: claw portion, 62: catching protrusion, 71: crest portion, 72: valley portion, 74: header flow passage, 75: planar portion, 81: engagement protrusion, 93: engagement hole, 94: cover space, 107: heat exchanger, 124: bridging header, 131: base, 132: corrugated sheet, 134: covering plate, 173: corrugated-sheet hole, 191: upper covering plate, 192: side covering plate, 207: heat exchanger, 224: bridging header, 232: corrugated sheet, 273: corrugated-sheet hole, **280*d*: before-heating hole, 280*u*: before-heating hole, 307: heat exchanger, 324: bridging header, 332: corrugated sheet, 380: before-heating hole, 407: heat exchanger, 424: bridging header, 431: base, 441: bottom base, 442: side base, 433: end plate, 453: plate-catching portion, 463**: cutout

The invention claimed is:

1. A heat exchanger comprising:

a heat transfer tube group made up of a plurality of heat transfer tubes, each heat transfer tube of the plurality of heat transfer tubes has, inside the heat transfer tube, a flow passage through which a refrigerant flows, the plurality of heat transfer tubes are arranged in a longitudinal direction so as to form a plurality of rows of heat transfer tubes, wherein corresponding heat transfer tubes in the respective rows are arranged in a lateral direction so as to be spaced apart from each other;

a fin provided on the heat transfer tubes and facilitating heat exchange between the refrigerant flowing inside the heat transfer tubes and air; and a bridging header into which end portions of the heat transfer tubes are inserted and that causes the refrigerant to flow between the heat transfer tubes arranged in the lateral direction of the heat transfer tube group, wherein the bridging header has:

a base having a flat plate shape and having insertion holes into which respective ones of the end portions of the heat transfer tubes are inserted;

a corrugated sheet being a plate having a shape of a wave in which crest portions and valley portions are continuously formed, each of the crest portions being provided so as to cover a pair of the insertion holes arranged in the lateral direction, each of the insertion holes having sides in the longitudinal direction of the base, the valley portions being in contact with the base on both of the sides of the each of the insertion holes in the longitudinal direction of the base so as to form a header flow passage between the corrugated sheet and the base, the header flow passage being configured to flow refrigerant through the header flow passage between corresponding heat transfer tubes of the plurality of heat transfer tubes arranged in the lateral direction of the heat transfer tube group; and a covering plate covering the corrugated sheet and pressing the corrugated sheet toward the base.

2. The heat exchanger of claim 1, wherein the corrugated sheet has corrugated-sheet holes, each of the corrugated-sheet holes being formed in a corresponding one of the crest portions, the refrigerant flows through the corrugated-sheet holes between the header flow passage and a cover space left between the corrugated sheet and the covering plate.

3. The heat exchanger of claim 2, the corrugated sheet having two end portions opposite from each other in the lateral direction, wherein the corrugated-sheet holes are formed in both of the two end portions of the corrugated sheet.

4. The heat exchanger of claim 2, wherein the corrugated-sheet holes are formed in the corrugated sheet and have been deformed by brazing of the bridging header, and wherein each of the corrugated-sheet holes had a rectangular shape before brazing.

5. The heat exchanger of claim 2, wherein the corrugated-sheet holes are formed in the corrugated sheet and have been deformed by brazing of the bridging header, and wherein each of the corrugated-sheet holes before brazing had a semicircular shape having a width in a range from 1 mm to a length of a planar portion of the corrugated sheet minus a processing tolerance.

6. The heat exchanger of claim 5, the corrugated sheet having two opposite sides opposite from each other in the lateral direction, wherein the corrugated-sheet holes had different widths before brazing, wherein the corrugated-sheet holes are respectively formed on the two opposite sides of the corrugated sheet.

7. The heat exchanger of claim 1, the corrugated sheet having an edge extending in the longitudinal direction, wherein the base has a bottom base into which the heat transfer tubes are inserted, the bottom base having an edge portion, and a side base extending in the longitudinal direction from the edge portion of the bottom base, along the edge of the corrugated sheet.

8. The heat exchanger of claim 7, each of the crest portions having end portions opposite to each other in the lateral direction, the side base having an inner wall surface, wherein the side base has a plurality of catching protrusions protruding from the inner wall surface and catching the end portions of the crest portions.

9. The heat exchanger of claim 7, the covering plate having a surface, wherein the side base has a claw portion that is in contact with the surface of the covering plate, the claw portion facing the corrugated sheet, and the claw portion presses the covering plate toward the corrugated sheet.

10. The heat exchanger of claim 9, the claw portion having two sides, wherein the side base has cutouts adjacent to both of the two sides of the claw portion.

11. The heat exchanger of claim 10, wherein a lower end portion of each of the cutouts is positioned below an upper surface of the covering plate.

12. A method of manufacturing a heat exchanger, the method comprising:

assembling:

a heat transfer tube group made up of a plurality of heat transfer tubes, each heat transfer tube of the plurality of heat transfer tubes has, inside the heat transfer tube, a flow passage through which a refrigerant flows, the plurality of heat transfer tubes are arranged in a longitudinal direction so as to form a plurality of rows of heat transfer tubes, wherein corresponding heat transfer tubes in the respective rows are arranged in a lateral direction so as to be spaced apart from each other;

a fin provided on the heat transfer tubes and facilitating heat exchange between the refrigerant flowing inside the heat transfer tubes and air; and a bridging header into which end portions of the heat transfer tubes are inserted and that causes the refrigerant to flow between the heat transfer tubes arranged in the lateral direction of the heat transfer tube group; and performing brazing of the heat transfer tube group, the fin, and the bridging header, wherein the assembling includes:

fitting a corrugated sheet of the bridging header into a base of the bridging header, the base of the bridging header having insertion holes into which respective ones of the end portions of the heat transfer tubes are inserted, the fitting being performed so that, in the corrugated sheet being a plate having a shape of a wave in which crest portions and valley portions are continuously formed, each of the crest portions covers a pair of the insertion holes arranged in the lateral direction, each of the insertion holes having sides in the longitudinal direction of the base, and the valley portions are in contact with the base on both of the sides of the each of the insertion holes in the longitudinal direction of the base; and carrying out attachment of a covering plate so that the covering plate covers the corrugated sheet.

13. The method of manufacturing the heat exchanger of claim 12, wherein an upper limit brazing temperature in the performing brazing is in a range from 580 degrees C. to 630 degrees C.

14. The method of manufacturing the heat exchanger of claim 12, further comprising forming corrugated-sheet holes in the corrugated sheet before the performing brazing, wherein each of the corrugated-sheet holes before the performing brazing has a rectangular shape.

15. The method of manufacturing the heat exchanger of claim 12, further comprising forming corrugated-sheet holes in the corrugated sheet before the performing brazing, wherein each of the corrugated-sheet holes before the performing brazing has a semicircular shape having a width in a range from 1 mm to a length of a planar portion of the corrugated sheet minus a processing tolerance.

16. The method of manufacturing the heat exchanger of claim 15, the corrugated sheet having two end portions opposite from each other in the lateral direction, an upper side, and a lower side, the bridging header having side bases, wherein, in the forming the corrugated-sheet holes, the corrugated-sheet holes are formed in both of the end portions of the corrugated sheet, the corrugated-sheet holes including a corrugated-sheet hole positioned on the upper side and a corrugated-sheet hole positioned on the lower side, wherein, in the performing brazing, the bridging header is disposed so that the side bases are positioned above and below across the corrugated sheet, and wherein, in the forming the corrugated-sheet holes in the corrugated sheet, the corrugated-sheet hole positioned on the upper side has a width smaller than a width of the corrugated-sheet hole positioned on the lower side.

* * * * *